US012059604B2

(12) United States Patent
Degerness et al.

(10) Patent No.: US 12,059,604 B2
(45) Date of Patent: Aug. 13, 2024

(54) LARGE SCALE BLADE PUTTERS

(71) Applicant: KARSTEN MANUFACTURING CORPORATION, Phoenix, AZ (US)

(72) Inventors: Josh A. Degerness, Scottsdale, AZ (US); Ryan M. Stokke, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 18/167,043

(22) Filed: Feb. 9, 2023

(65) Prior Publication Data

US 2023/0249039 A1 Aug. 10, 2023

Related U.S. Application Data

(60) Provisional application No. 63/267,833, filed on Feb. 10, 2022.

(51) Int. Cl.
*A63B 53/04* (2015.01)

(52) U.S. Cl.
CPC ..... *A63B 53/0487* (2013.01); *A63B 53/0408* (2020.08)

(58) Field of Classification Search
CPC ..... A63B 53/007; A63B 53/0408; A63B 53/0487
See application file for complete search history.

(56) References Cited

U.S. PATENT DOCUMENTS

D207,227 S 3/1967 Solheim
D239,951 S 5/1976 Carrier
4,693,478 A 9/1987 Long
4,741,535 A 5/1988 Leonhardt
4,754,976 A * 7/1988 Pelz ..... A63B 53/0487 473/340
4,898,387 A * 2/1990 Finney ..... A63B 53/0487 473/341
5,078,398 A * 1/1992 Reed ..... A63B 53/0487 273/DIG. 8
D323,867 S 2/1992 Rizzotto
5,131,656 A * 7/1992 Kinoshita ..... A63B 53/0487 473/341
D350,177 S 8/1994 Ramirez
D359,330 S 6/1995 Channell
5,558,332 A * 9/1996 Cook ..... A63B 53/0487 473/341

(Continued)

FOREIGN PATENT DOCUMENTS

JP 2005185372 A * 7/2005 ..... A63B 53/0441

OTHER PUBLICATIONS https://www.2ndswing.com/nike/golf-putters/everclear-e33/#used , Nike Everclear E33 Putter, Jun. 13, 2017.

(Continued)

*Primary Examiner* — Alvin A Hunter

(57) ABSTRACT

Embodiments of a blade style putter type club head comprising enlarged physical features such as an enlarged length, height, and depth. The enlarged physical features, specifically the enlarged length allows mass to be positioned further from the center of gravity. The positioning of the mass away from the center of gravity allows the blade style club head to achieve an increased MOIyy creating a more forgiving blade style putter type club head.

20 Claims, 15 Drawing Sheets

(56) References Cited

U.S. PATENT DOCUMENTS

| | | | | |
|---|---|---|---|---|
| D381,382 | S | 7/1997 | Fenton, Jr. | |
| D389,207 | S | 1/1998 | Cameron | |
| 5,997,409 | A | 12/1999 | Mattson | |
| D421,471 | S | 3/2000 | Moldovan | |
| 6,086,484 | A * | 7/2000 | Uebelhor | A63B 53/0487 473/251 |
| D436,638 | S | 1/2001 | Carrier | |
| D443,906 | S | 6/2001 | Hettinger | |
| 6,634,956 | B1 | 10/2003 | Pegg | |
| D485,320 | S | 1/2004 | Breier | |
| 6,679,782 | B2 * | 1/2004 | Tang | A63B 53/04 473/340 |
| 6,746,344 | B1 * | 6/2004 | Long | A63B 53/0487 473/332 |
| 6,896,625 | B2 * | 5/2005 | Grace | A63B 60/02 473/340 |
| 6,984,181 | B2 * | 1/2006 | Hettinger | A63B 53/0487 473/340 |
| 6,988,959 | B2 * | 1/2006 | Pollman | A63B 53/0487 473/340 |
| 7,004,849 | B2 * | 2/2006 | Cameron | A63B 53/065 473/340 |
| D517,143 | S | 3/2006 | Petsel | |
| D521,580 | S | 5/2006 | Burrows | |
| D532,844 | S | 11/2006 | Rollinson | |
| D532,845 | S | 11/2006 | Rollinson | |
| 7,147,569 | B2 * | 12/2006 | Tang | A63B 53/0487 473/340 |
| 7,166,036 | B2 * | 1/2007 | Byrne | A63B 53/0487 473/340 |
| D548,294 | S | 8/2007 | Nguyen | |
| 7,270,609 | B2 * | 9/2007 | Yamaguchi | A63B 53/0487 473/341 |
| D552,196 | S | 10/2007 | Hueber | |
| D564,607 | S | 3/2008 | Oldknow | |
| 7,344,451 | B2 * | 3/2008 | Tang | A63B 53/0487 473/340 |
| 7,351,162 | B2 * | 4/2008 | Soracco | A63B 60/02 473/340 |
| D568,954 | S | 5/2008 | Oldknow | |
| 7,377,858 | B2 * | 5/2008 | Kubota | A63B 53/0487 473/340 |
| D573,673 | S | 7/2008 | Noyes | |
| D574,908 | S | 8/2008 | Hettinger | |
| D582,497 | S | 12/2008 | Rollinson | |
| 7,491,135 | B1 * | 2/2009 | Rollinson | A63B 60/54 473/342 |
| D589,575 | S | 3/2009 | Kim | |
| D590,461 | S | 4/2009 | Kim | |
| D590,462 | S | 4/2009 | Hettinger | |
| D591,807 | S | 5/2009 | Rollinson | |
| D594,917 | S | 6/2009 | Stellander | |
| D595,373 | S | 6/2009 | Kim | |
| D604,787 | S | 11/2009 | Hopkins | |
| D620,993 | S | 8/2010 | Laub | |
| D621,458 | S | 8/2010 | Serrano | |
| 7,927,226 | B1 | 4/2011 | Twitty | |
| D643,893 | S | 8/2011 | Rollinson | |
| D648,407 | S | 11/2011 | Teramoto | |
| D670,774 | S | 11/2012 | Seiff | |
| D688,341 | S | 8/2013 | Rollinson | |
| D691,225 | S | 10/2013 | Hilton | |
| D691,226 | S | 10/2013 | Hilton | |
| D701,274 | S | 3/2014 | Rollinson | |
| D720,821 | S | 1/2015 | Brandt | |
| D728,715 | S | 5/2015 | Cameron | |
| D730,464 | S | 5/2015 | Cameron | |
| D731,605 | S | 6/2015 | Rollinson | |
| 9,375,615 | B2 * | 6/2016 | Park | A63B 53/02 |
| D768,248 | S | 10/2016 | Rollinson | |
| D769,383 | S | 10/2016 | Abbott | |
| 9,474,948 | B2 * | 10/2016 | Dolezel | A63B 53/0487 |
| D771,208 | S | 11/2016 | Bettinardi | |
| D773,573 | S | 12/2016 | Abbott | |
| D776,771 | S | 1/2017 | Peterson | |
| D777,270 | S | 1/2017 | Rollinson | |
| D796,597 | S | 9/2017 | Serrano | |
| D799,617 | S | 10/2017 | Becktor | |
| D801,459 | S | 10/2017 | Rollinson | |
| D807,453 | S | 1/2018 | Serrano | |
| 9,925,427 | B2 | 3/2018 | Bischmann | |
| D815,222 | S | 4/2018 | Serrano | |
| D817,424 | S | 5/2018 | Toulon | |
| D818,551 | S | 5/2018 | Toulon | |
| D832,379 | S | 10/2018 | Jertson | |
| D832,381 | S | 10/2018 | Serrano | |
| D844,722 | S | 4/2019 | Wang | |
| D857,135 | S | 8/2019 | Serrano | |
| D859,544 | S | 9/2019 | Wang | |
| D867,495 | S | 11/2019 | Cameron | |
| D869,582 | S | 12/2019 | Rollinson | |
| D869,583 | S | 12/2019 | Rollinson | |
| D874,590 | S | 2/2020 | Lee | |
| D892,954 | S | 8/2020 | Clarke | |
| D893,645 | S | 8/2020 | Serrano | |
| D895,038 | S | 9/2020 | Cameron | |
| D898,845 | S | 10/2020 | Clarke | |
| D912,746 | S | 3/2021 | Toulon | |
| D921,140 | S | 6/2021 | Serrano | |
| D930,095 | S | 9/2021 | Wang | |
| D936,770 | S | 11/2021 | Cameron | |
| D941,411 | S | 1/2022 | Wang | |
| 2020/0101357 | A1 * | 4/2020 | Higdon | A63B 53/0487 |
| 2021/0245020 | A1 | 8/2021 | Higdon | |
| 2021/0362011 | A1 | 11/2021 | Higdon | |

OTHER PUBLICATIONS https://www.scottycameron.com/archives/putters/2016/futura-x/futura-x5/ , Futura XS , Jun. 13, 2017.
http://www.clevelandgolf.com/en/clubs-/tfi-2135-elevado-putter/MTFI2135ELEV.html , TFI 2135 Elevado Putter , Jun. 13, 2017.
http://rifegolf.com/store#!/~/product/category=8856002&id=34 731881 , Rife General Left-hand Putter , Jun. 13, 2017.
TitleistR 2015, p. 41, Acushnet Japan, Inc. Feb. 2015.
https://www.google.com/search?q=karsten+putters&source=Inms&tbm=isch&sa=X&ved=2ahUKEwiY6K-Tivb4AhVhEVkFHeobDesQ_AUoAnoECAE; karsten putters google search; Jul. 12, 2022.
https://ping.com/en-us/clubs/putters; ping.com; Jul. 12, 2022.

* cited by examiner

LARGE SCALE BLADE PUTTERS

CROSS REFERENCE PRIORITIES

This claims the benefit of U.S. Provisional Application No. 63/267,833, filed Feb. 10, 2022, the contents of which are fully incorporated herein by reference.

TECHNICAL FIELD

This disclosure relates generally to golf clubs and relates more particularly to blade style putter type golf club heads having a larger length, measured in a heel-to-toe direction, over traditional blade style putter type golf club heads.

BACKGROUND

The two main types of putter styles include mallet style putters and blade style putters. When compared, the blade style putter is typically much thinner (in a face to rear direction) than the mallet style putter. Blade style putters have comprised relatively the same shape throughout the years, while the mallet style putter has evolved from the original half circle design to include a variety of shapes and sizes. In most situations, the weight of a blade style putter is greater than its mallet counterpart. However, the physical size of a mallet style putter is typically larger than a blade style putter. The larger size of the mallet style putter allows for a higher moment of inertia (MOI), which allows the mallet style putter to be more forgiving.

Blade style putters, however, have their advantages too. A blade style putter provides more control over ball speed, as well as providing a better feel, in comparison to a mallet style putter. Blade style putters, further provide a clean alignment to a golf ball. Therefore, there is a need in the art for a blade style putter type golf club head blade style putter that continues to provide the desired control and feel of a traditional blade style putter, while also possessing the forgiveness of a traditional mallet style putter type golf club head.

BRIEF DESCRIPTION OF THE DRAWING

To facilitate further description of the embodiments, the following drawings are provided in which.

Figure 1:
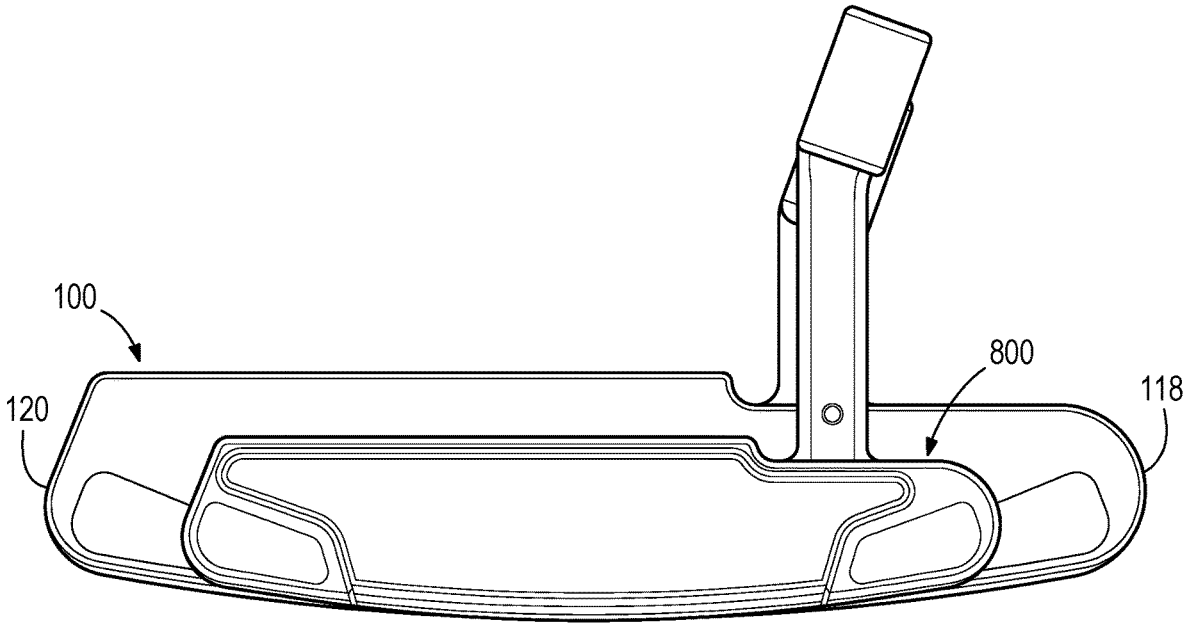
FIG. 1 illustrates a front view of the golf club according to a first embodiment relative to prior art.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

Described herein is an enlarged blade style putter type golf club head (also referred to as "blade style club head" or "enlarged blade style club head") blade style club head over traditional mallet style putter type golf club head (also referred to as "traditional mallet style club head") traditional blade style club head. The enlarged blade style club head, and more specifically the enlarged length allows for the majority of the mass to be positioned towards the perimeter of the blade style club head. The positioning of the majority of the mass towards the perimeter allows the enlarged blade style club head to achieve a larger MOIyy than both a traditional blade style club head and a traditional mallet style club head and is therefore more forgiving. The increase in MOIyy prevents undesirable rotation about the y-axis and helps to ensure the strikeface is square at impact. This enlarged blade style club head achieves better performance by incorporating the forgiveness typically associated with mallet style putters into a blade style putter. The improved performance can be attributed to the enlarged geometric size of the enlarged blade style club head, and more specifically to the enlarged length.

The enlarged geometric blade style club head gives players the high forgiveness typically associated with a traditional mallet style golf club head, while still possessing the desired control and feel associated with a traditional blade style golf club head. As discussed below, the enlarged size warranted some concerns in the visual appeal of the blade style club head, however it was deemed the performance of the blade style club head overcame any concerns. The enlarged blade style club head yielded on average 4.00% less putts when compared to both a traditional blade style club head and a traditional mallet style club head. This equated to about 2-3 strokes per round and a lowering of one's handicap by up to 1 on the GHIN scale (USGA). The enlarged length and the positioning of the perimeter weighting allows the enlarged blade style club head to achieve up to an 85% larger MOIyy than a traditional blade style club head and up to a 30% larger MOIyy than a traditional mallet style golf club head.

Definitions

The terms "include," and "have," and any variations thereof, are described herein to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The term "strikeface," as described herein, refers to a club head front surface that is configured to strike a golf ball. The term strikeface can be used interchangeably with the term "face."

The term "strikeface perimeter," as described herein, can refer to an edge of the strikeface. The strikeface perimeter can be located along an outer edge of the strikeface where the curvature deviates from a bulge and/or roll of the strikeface.

The term "geometric centerpoint," or "geometric center" of the strikeface, as described herein, can refer to a geometric centerpoint of the strikeface perimeter, and at a midpoint of the face height of the strikeface. In the same or other examples, the geometric centerpoint also can be centered with respect to an engineered impact zone, which can be defined by a region of grooves on the strikeface. As another approach, the geometric centerpoint of the strikeface can be located in accordance with the definition of a golf governing body such as the United States Golf Association (USGA).

The term "ground plane," as described herein, can refer to a reference plane associated with the surface on which a golf ball is placed. The ground plane can be a horizontal plane tangent to the sole at an address position.

The term "loft plane," as described herein, can refer to a reference plane that is tangent to the geometric centerpoint of the strikeface.

The term "loft angle," as described herein, can refer to an angle measured between the loft plane and the XY plane (defined below).

The term "lie angle," as described herein, can refer to an angle between a hosel axis, extending through the hosel, and the ground plane. The lie angle is measured from a front view.

The term "toe-ward," as described herein, refers to a direction extending substantially toward the club head toe.

The term "heel-ward," as described herein, refers to a direction extending substantially toward the club head heel.

The term "forward," as described herein, refers to a direction extending substantially toward the club head face.

The term "rearward," as described herein, refers to a direction extending substantially toward the club head rear.

The "depth" of the blade style putter type club head (also referred to as "blade style club head"), as described herein, can be defined as a front-to-rear dimension of the blade style club head.

The "height" of the blade style club head, as described herein, can be defined as a top rail-to sole dimension of the blade style club head. In many embodiments, the height of the club head can be measured according to a golf governing body such as the United States Golf Association (USGA).

The "length" of the blade style club head, as described herein, can be defined as a heel-to-toe dimension of the blade style club head. In many embodiments, the length of the club head can be measured according to a golf governing body such as the United States Golf Association (USGA).

The "face height" of the blade style club head, as described herein, can be defined as a height measured parallel to the loft plane between a top end of the strikeface perimeter near the top rail and a bottom end of the strikeface perimeter near the sole.

The "leading edge" of the club head, as described herein, can be identified as the most sole-ward portion of the strikeface perimeter.

An "XYZ" coordinate system of the blade style club head, as described herein, is based upon the geometric center of the strikeface. The blade style club head dimensions as described herein can be measured based on a coordinate system as defined below. The geometric center of the strikeface defines a coordinate system having an origin positioned on the leading edge at the center of the blade style club head. The coordinate system defines an x-axis, a y-axis, and a z-axis. The x-axis extends through the geometric center of the strikeface in a direction from the heel to the toe of the blade style club head. The y-axis extends through the geometric center of the strikeface in a direction from the top rail to the sole of the blade style club head. The y-axis is perpendicular to the x-axis. The z-axis extends through the geometric center of the strikeface in a direction from the strike face to the rear of the blade style club head. The z-axis is perpendicular to both the x-axis and the y-axis.

The term or phrase "center of gravity position" or "CG location" as described herein refers to the location of the club head center of gravity (CG) with respect to the XYZ coordinate system, wherein the CG position is characterized by locations along the x-axis, the y-axis, and the z-axis. The term "CGx" can refer to the CG location along the x-axis, measured from the origin point. The term "CG height" can refer to the CG location along the y-axis, measured from the origin point. The term "CGy" can be synonymous with the CG height. The term "CG depth" can refer to the CG location along the z-axis, measured from the origin point. The term "CGz" can be synonymous with the CG depth.

The term or phrase "perimeter weight center of gravity" or "$CG_w$" as described herein refers to the location of the perimeter weight center of gravity ($CG_w$) with respect to the XYZ coordinate system, wherein the CG position is characterized by locations along the x-axis, the y-axis, and the z-axis. The term "CGwx" can refer to the $CG_w$ location along the x-axis, measured from the origin point. The term "CGwy" can refer to the $CG_w$ location along the y-axis, measured from the origin point. The term "CGwz" can refer to the $CG_w$ location along the z-axis, measured from the origin point.

Figure 7A:
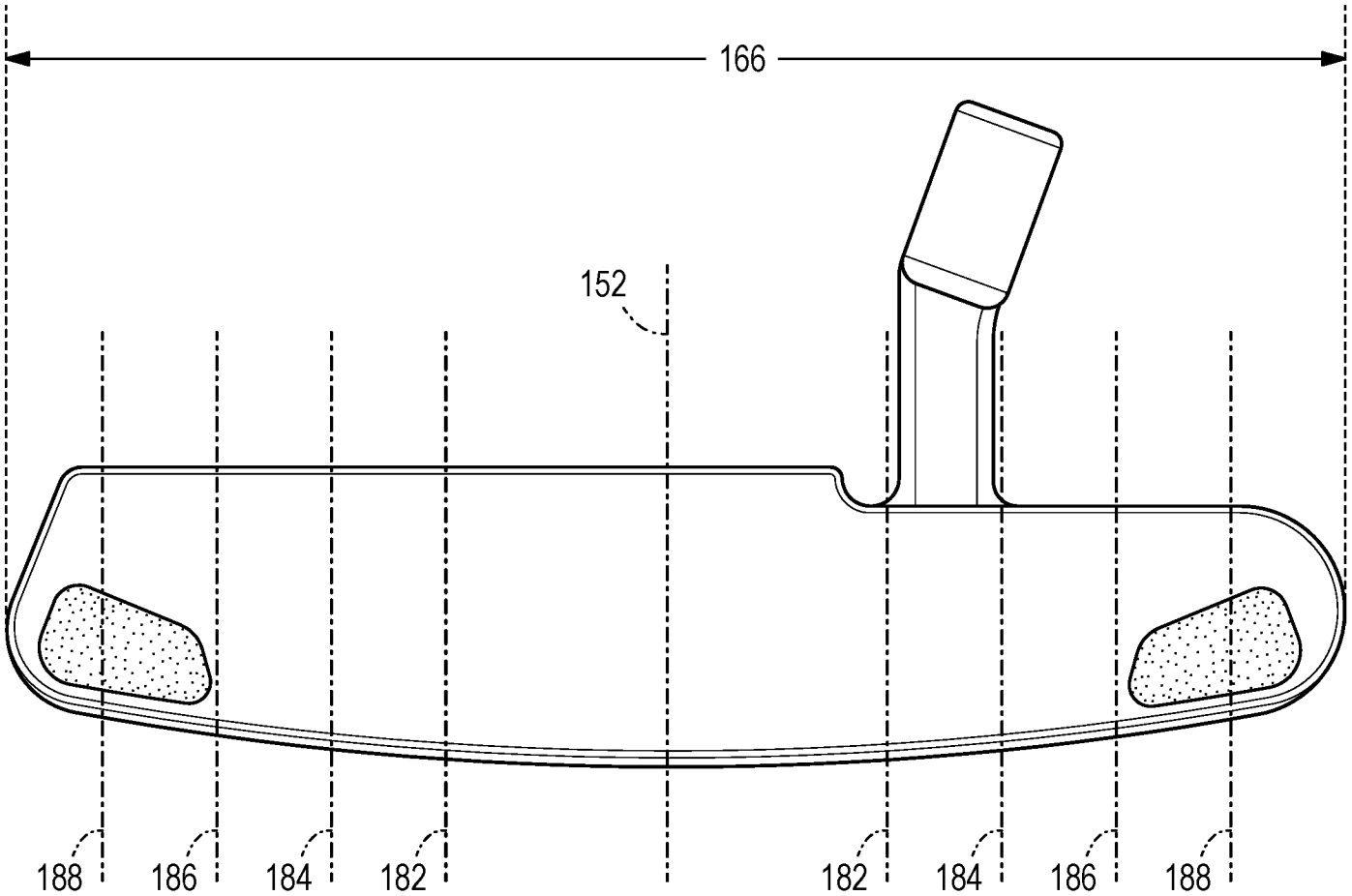
FIG. 7*a*: illustrates a front view of the golf club of FIG. 2.
Figure 7B:
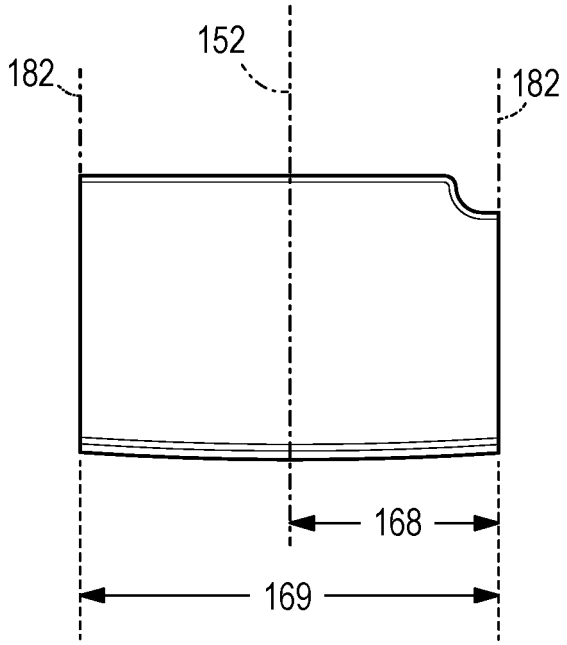
FIG. 7*b*: illustrates a sliced section of the golf club of FIG. 7*a*.
Figure 7C:
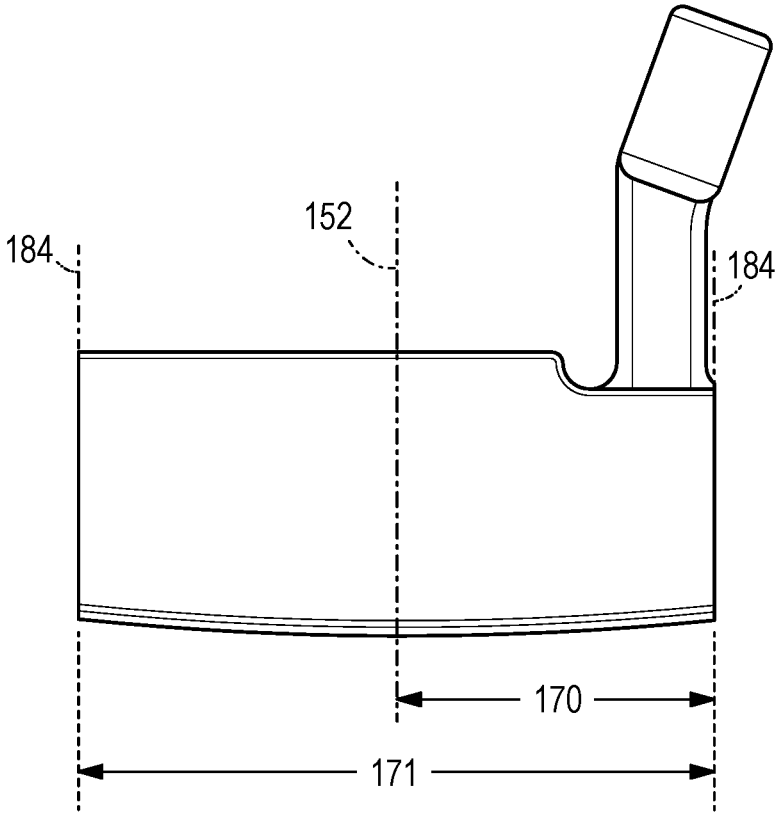
FIG. 7*c*: illustrates a sliced section of the golf club of FIG. 7*a*.
Figure 7D:
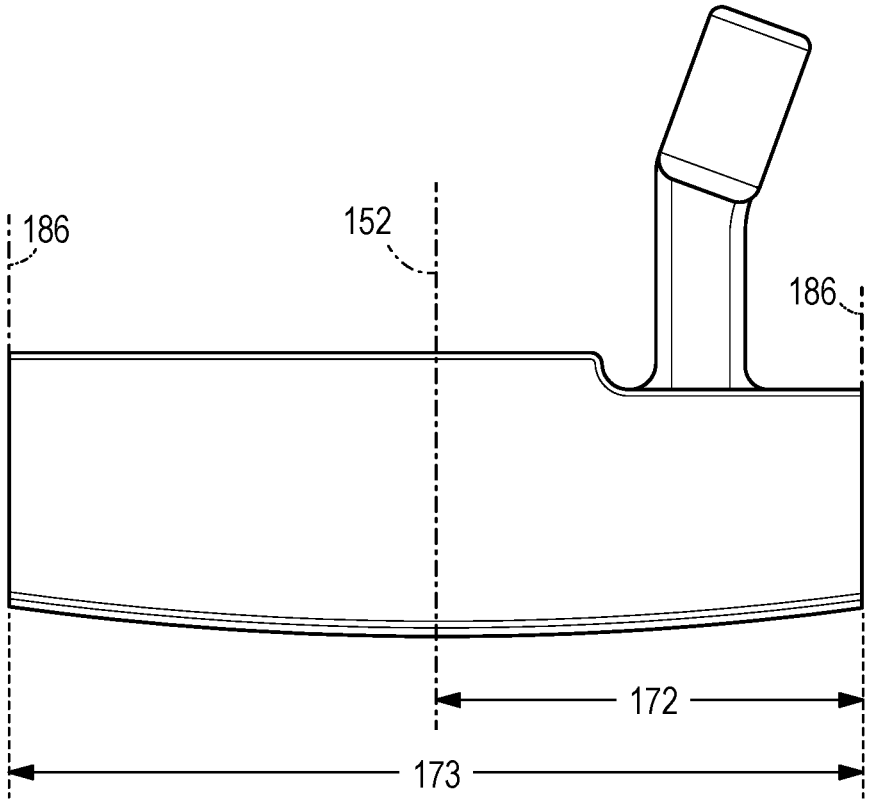
FIG. 7*d*: illustrates a sliced section of the golf club of FIG. 7*a*.
Figure 7E:
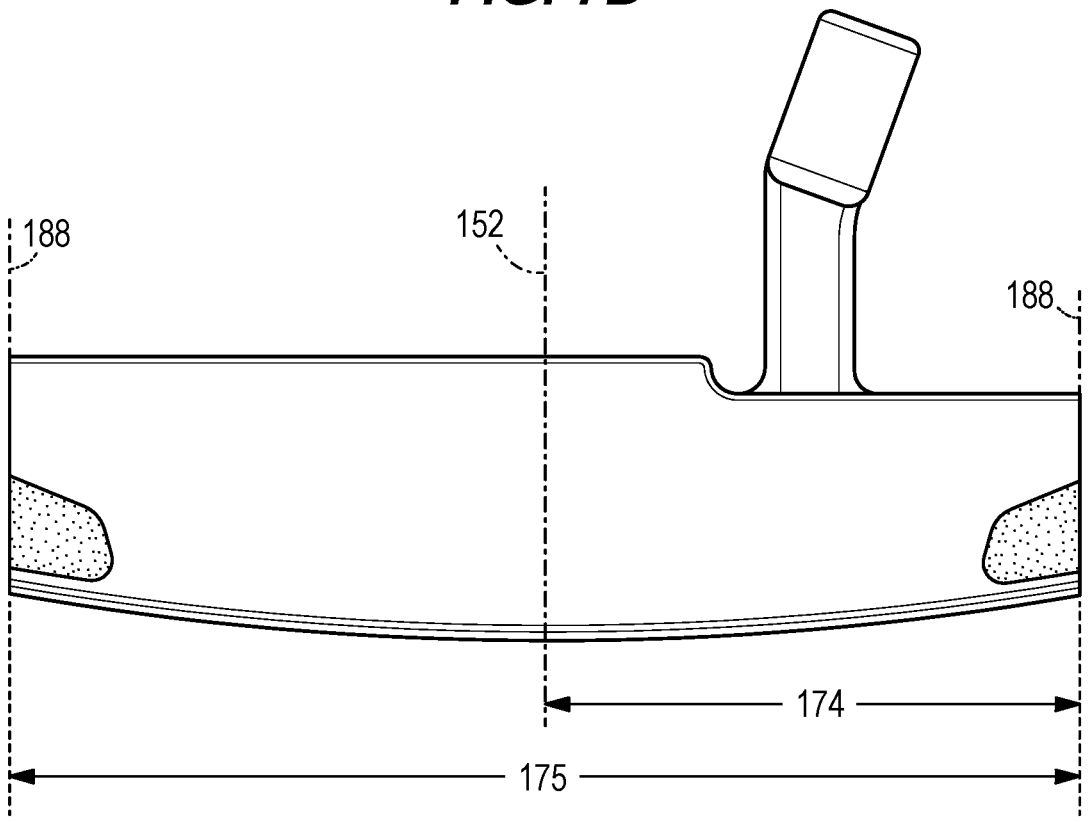
FIG. 7*e*: illustrates a sliced section of the golf club of FIG. 7*a*.

The term "geometric center plane" or "GC plane" of the golf club, as described herein, as described herein refers to a midplane of the body that extends from the strikeface to the rear. Referring to FIG. 7*a*, the GC plane can extend from the strikeface to the rear and can be located at a midpoint between the heel and the toe. The GC plane can be perpendicular to the ground plane.

The term "face height" of the blade style club head, as described herein, can be defined as a height measured parallel to the loft plane between a top end of the strikeface perimeter near the top rail and a bottom end of the strikeface perimeter near the sole.

The term "shaft axis" of the golf club, as described herein, can be defined as an axis that extends from a geometric center of the tip end to a geometric center of the butt end.

The term or phrase "moment of inertia" (hereafter "MOI") as described herein, refers to values measured about the CG. The term "MOIxx" as described herein, refers refer to the MOI measured in the heel-to-toe direction, parallel to the x-axis. The term "MOIyy" as described herein, refers to the MOI measured in the sole-to-top rail direction, parallel to the y-axis. The term "MOIzz" as described herein, refers to the MOI measured in the front-to-back direction, parallel to the z-axis. The MOI values MOIxx, MOIyy, and MOIzz provides a means to measure forgiveness for off-center impacts between the golf ball and the golf club head.

DESCRIPTION

I. Putter Type Blade Style Club Head with Enhanced Length

Described herein is a blade style putter type golf club (hereafter referred to as "blade style club head") having the high forgiveness typically associated with a traditional mallet style putter type club head (also referred to as "traditional mallet style club head"), while still possessing the desired control and feel associated with a traditional blade style club head. This enhanced length blade style club head is achieved by significantly enlarging the geometric size including but not limited to the length and combining particular weight ratios from the geometric center of the blade style club head, as described herein, in comparison to a traditional blade style club head. More specifically, the increased face height, length, and depth of the current embodiment, as well as the positioning of the perimeter weighting, allows for the majority of the mass to be positioned towards the perimeter of the blade style club head. This allows the blade style club head to achieve a larger MOI than a traditional blade style putter type club head (also referred to as "traditional blade style club head") and is therefore more forgiving over a traditional blade style golf club head. The enlarged geometric size could initially be imposing to some players, however, it was deemed through testing, as described below, the playability of the blade style club head overcame these impositions and yielded an average of 4.00% less putts. The increased number of putts made could translate to a stroke savings of 1-2 strokes per round, and to a 1 to 2 stroke savings on a player's handicap.

The overall features of the blade style club head are similar to those of a traditional blade style putter. Yet, the features differ (as described below) in length, depth, height, and weight position which is tantamount to the blade style club head. The blade style club head can comprise a strikeface, and a rear wall opposite the strikeface. The blade style club head can comprise a top rail positioned adjacent to the strikeface and adjacent to the rear wall. The blade style club head can further comprise a sole opposite the top rail, and a leading edge adjacent to both the strikeface and the sole.

As discussed above, increases the dimensions, specifically the length, depth, height, and weight positioning allow the blade style club head to achieve the desired level of forgiveness. The blade style club head dimensions, as described herein, can be measured based on a XYZ coordinate system as defined below. The XYZ coordinate system can be seen in FIG. 2. The XYZ coordinate system can further comprise an origin positioned on the leading edge at the center of the strikeface. The XYZ coordinate system defines an x-axis, a y-axis, and a z-axis. The x-axis extends through the origin of the strikeface in a direction from the heel to the toe. The y-axis extends through the origin of the strikeface in a direction from the top rail to the sole. The y-axis is perpendicular to the x-axis. The z-axis extends through the origin of the strikeface in a direction from the front end to the rear. The z-axis is perpendicular to both the x-axis and the y-axis.

A. Length and Mass Distribution

The blade style club head can comprise a length measured in a direction parallel to the x-axis from an outer most point of the toe to an outer most point of the heel. The length can be between 4.50 inches and 7.00 inches. In some embodiments, the length can be between 4.50 inches and 4.75 inches, 4.75 inches and 5.00 inches, 5.00 inches and 5.25 inches, between 5.25 inches and 5.50 inches, between 5.50 inches and 5.75 inches, between 5.75 inches and 6.00 inches, between 6.00 inches and 6.25 inches, between 6.25 inches and 6.50 inches, between 6.50 inches and 6.75 inches, and between 6.75 inches and 7.00 inches. In one exemplary embodiment, the length is 6.00 inches. In some embodiments, the length can be greater than 4.50 inches, greater than 5.00 inches, greater than 5.50 inches, greater than 6.00 inches, or greater than 6.50 inches.

The length can be significantly larger than the length of a traditional blade style golf club head. The length of the blade style club head, described herein, can comprise up to a 35% increase in length when compared to the traditional blade style golf club head. The increased length, as described herein, can allow for the ability to increase the MOI by moving mass away from the center of gravity (CG).

The total mass of the blade style club head, as described herein, can comprise relatively the same total mass as the traditional blade putter. In many embodiments, the blade style club head can have a total mass that ranges between 320 and 380 grams. In some embodiments, the total mass of the blade style club head can range between 320 grams and 325 grams, 325 grams and 330 grams, 330 grams and 335 grams, 335 grams and 340 grams, 340 grams and 345 grams, 345 grams and 350 grams, 350 grams and 355 grams, 355 grams and 360 grams, 360 grams and 365 grams, 365 grams and 370 grams, 370 grams and 375 grams, or 375 grams and 380 grams. In one exemplary embodiment, the total mass is 345 g. The total mass of the blade style club head can have a direct effect on the control the player has on a putt and more specifically the control the player has over the speed of the putt.

As discussed above the increase in length allows for the movement of mass away for the CG. The 20-35% increase in length is a core ingredient to the ability of the blade style putter to perform like a traditional mallet style putter. This can be accomplished by adding perimeter weights in particular zones outward from the center plane of the blade style club head. The perimeter weighting can be accomplished in different ways such as (but not limited to) denser weights such as tungsten—or any material with a density greater than 8-12 (g/cm$^3$), thickened regions of mass on the putter perimeters, or a mixture of hybrid materials with greater density outward from the center. One such use of perimeter weighting is one or more perimeter weights.

Figure 11:
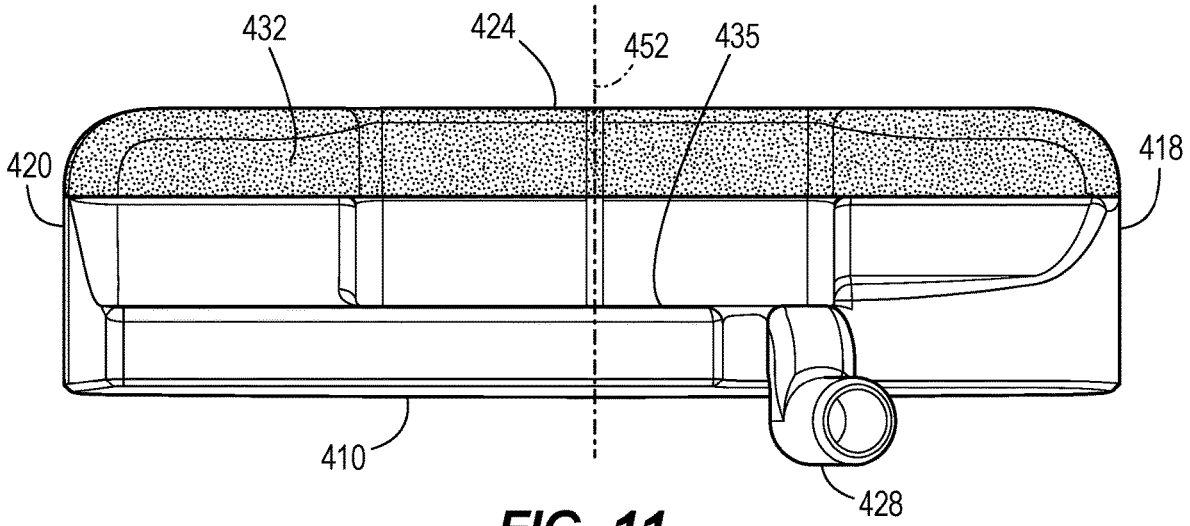
FIG. 11: illustrates a top view of the golf club according to a fourth embodiment.

A means of adding weight to the perimeter for increasing the MOI of the putter can be accomplished by the addition of perimeter weights. In some embodiments, as seen in FIG. 11, the perimeter weights can consist of one or more bar weights positioned on the rear of the club head. In some embodiments, the perimeter weights can further comprise a plurality of toe weights and a plurality of heel weights. The plurality of toe weights can comprise one or more weights positioned toeward of the GC (geometric center) plane. In some embodiments, the plurality of toe weights can comprise 1 weight, 2 weights, 3 weights, 4 weights, or 5 weights. The plurality of heel weights can comprise one or more weights positioned heelward of the GC plane. In some embodiments, the plurality of heel weights can comprise 1 weight, 2 weights, 3 weights, 4 weights, or 5 weights. The perimeter weights can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape.

In many embodiments, the perimeter weights can be formed separately and coupled to the blade style club head. In such embodiments, a portion of the blade style club head with a compatible geometry to the perimeter weights can be machined out so the perimeter weights can be coupled to the blade style club head via welding, soldering, brazing, swaging, adhesion, epoxy, mechanical fastening, or any other suitable joining method. In such embodiments, the perimeter weights can be coupled to the strikeface, the rear, sole, heel, or toe. In many embodiments, the perimeter weights can be formed of a material comprising a density greater than the density of the blade style club head. The inclusion of the perimeter weight(s) allows for high amounts of mass to be concentrated in specific locations to improve the mass properties of the blade style club head.

Each perimeter weight can comprise a mass. In many embodiments, the mass of a single perimeter weight can be between 5 grams and 75 grams. In some embodiments, the mass of a single perimeter weight can be between 5 grams and 10 grams, 10 grams and 15 grams, 15 grams and 20 grams, 20 grams and 25 grams, 25 grams and 30 grams, 30 grams and 35 grams, 35 grams and 40 grams, 40 grams and 45 grams, 45 grams and 50 grams, 50 grams and 55 grams, 60 grams and 65 grams, 65 grams and 70 grams, or 70 grams and 75 grams.

The addition of the perimeter weights can allow for a shift in weight, towards the peripheries of the blade style club head, which can increase the MOI or forgiveness of the club head. The position of the perimeter weights relative to the CG can greatly increase the MOI and shift the CG of the club head. The perimeter weights can further comprise a center of gravity (hereafter referred to as "the $CG_w$"). The $CG_w$ can be positioned a distance away from the y-axis. More specifically, the length, as previously mentioned, can allow the position of the perimeter weights to be positioned further from the y-axis, providing a greater impact on the MOIyy. Therefore, the greater the distance of the $CG_w$ from the y-axis the greater the increase of the MOIyy. In some embodiments, the distance from the y-axis to the $CG_w$ can be between ±1.5 inches and ±3.5 inches. In some embodiments, the distance from the y-axis to the $CG_w$ can be between ±1.50 inches and ±1.75 inches, ±1.75 inches and ±2.00 inches, ±2.00 inches and ±2.25 inches, ±2.25 inches and ±2.50 inches, ±2.50 inches and ±2.75 inches, ±2.75 inches and ±3.00 inches, ±3.00 inches and ±3.25 inches, or ±3.25 inches and ±3.50 inches. In some embodiments, the distance from the y-axis to the $CG_w$ can be greater than ±1.50 inches, greater than ±1.75 inches, greater than ±2.00 inches, greater than ±2.25 inches, greater than ±2.50 inches, greater than ±2.75 inches, greater than ±3.00 inches, or greater than ±3.25 inches.

As shown in FIG. 7*a*, the blade style club head described herein can comprise several sets of planes. Wherein the planes are positioned a distance, relative to the x-axis, from the GC plane and are parallel to the GC plane. The planes included to provide sections of the golf club head to highlight the weight distribution in each section.

The first set of planes can be positioned a distance "L1" from the GC plane. In some embodiments, L1 can be ±1.0 inches from the GC plane. The first set of planes can further be positioned a distance "L2" from each other. In some embodiments, L2 can be 2.0 inches. A percent of the total mass is positioned outside (toeward or heelward) the first set of planes. In some embodiments, between 65% and 85% of the total mass is positioned outside the first set of planes. In some embodiments, the percentage of total mass positioned outside the first set of planes is between 65% and 70%, 70% and 75%, 75% and 80%, or 80% and 85% of the total mass. In some embodiments, the percentage of the total mass of the club head positioned outside the first set of planes is greater than 65%, greater than 70%, greater than 75%, greater than 80% or greater than 85%. In one exemplary embodiment, the percentage of the blade style club head total mass positioned outside the first set of planes is 75%. The percentage of the blade style club head total mass positioned outside the first set of planes, can be up to 15% greater when compared to a traditional blade style golf club head.

The second set of planes can be positioned a distance "L3" from the GC plane. In some embodiments, L3 can be ±1.5 inches from the GC plane. The second set of planes can further be positioned a distance "L4" from each other. In some embodiments, L4 can be 3.0 inches. A percent of the total mass is positioned outside (toeward or heelward) the second set of planes. In some embodiments, between 45% and 65% of the total mass is positioned outside the second set of planes. In some embodiments, the percentage of total mass positioned outside the second set of planes is between 45% and 50%, 50% and 55%, 55% and 60%, or 60% and 65% of the total mass. In some embodiments, the percentage of the total mass positioned outside the second set of planes is greater than 45%, greater than 50%, greater than 55%, greater than 60% or greater than 65%. In one exemplary embodiment, the percentage of the total mass positioned outside the second set of planes is 58%.

The MOIyy can be significantly increased when more than half of the blade style club heads total mass is positioned closer to the perimeter than the center. The increased MOIyy can prevent rotation about the y-axis when a miss hit occurs, thereby making the club more forgiving. The percentage of the blade style club head total mass positioned outside the second set of planes, can be up to 70% greater when compared to a traditional blade style golf club head.

The third set of planes can be positioned a distance "L5" from the GC plane. In some embodiments, L5 can be ±2.0 inches from the GC plane. The third set of planes can further be positioned a distance "L6" from each other. In some embodiments, L6 can be 4.0 inches. A percent of the total mass is positioned outside (toeward or heelward) the third set of planes. In some embodiments, between 30% and 50% of the total mass is positioned outside the third set of planes. In some embodiments, the percentage of the total mass positioned outside the third set of planes is between 30% and 35%, 35% and 40%, 40% and 45%, or 45% and 50%. In some embodiments, the percent of the total mass of the blade style club head positioned outside the third set of planes is greater than 30%, greater than 35%, greater than 40%, greater than 45% or greater than 50%. In one exemplary embodiment, the percentage of total mass positioned outside the third set of planes is 40%. The percentage of the blade style club head total mass positioned outside the third set of planes, can be 400% greater when compared to the traditional blade style golf club head.

The fourth set of planes can be positioned a distance "L7" from the GC plane. In some embodiments, L7 can be ±2.5 inches from the GC plane. The fourth set of planes can further be positioned a distance "L8" from each other. In some embodiments, L8 can be 5.0 inches. A percent of the total mass is positioned outside (toeward or heelward) the fourth set of planes. In some embodiments, between 5% and 25% of the total mass is positioned outside the fourth set of planes. In some embodiments, the percentage of total mass positioned outside the fourth set of planes is between 5% and 10%, 10% and 15%, 15% and 20%, or 20% and 25% of the total mass. In some embodiments, the percentage of total mass of the clubhead positioned outside the fourth set of planes is greater than 5%, greater than 10%, greater than 15%, greater than 20% or greater than 25%. In one exemplary embodiment, the percentage of total mass positioned outside the fourth set of planes is 17%.

The increased perimeter weighting, along with the larger dimensions of the blade style club head described herein, allows for an increased percentage of the blade style club head's total mass to be positioned away from the CG. This length increase between 20-35% along with placement of mass in the zones further from the center axis of the putter leads to a more down and back positioning of the CG of the blade style club head, leading to create improvements in MOI. The Center of Gravity or "the CG" as described above, can also affect the putting stroke itself as well as the outcome of the putting stroke (i.e. the performance of the golf ball). More specifically, the position of the CG influences the top spin imparted on the golf ball and the ability for the club head to produce smooth rolling putts. The position of the CG relative to the y-axis (hereafter referred to as "the CGy") will determine the point of zero twist or sweet spot. The position of the CG relative to the x-axis (hereafter referred to as "the CGx") will affect the launch as well as the spin of the golf ball. The position of the CG relative to the z-axis (hereafter referred to as "the CGz") will also affect the launch and spin of the golf ball, as well as the forgiveness of the blade style club head.

The CGx, as described above, is the positioned of the CG, relative to the x-axis, from the origin. In some embodiments, the CGx can be between 0.00 inches and 0.10 inches. In some embodiments, the CGx can be between 0.00 inches and 0.01 inches, 0.01 inches and 0.02 inches, 0.02 inches and 0.03 inches, 0.03 inches and 0.04 inches, 0.04 inches and 0.05 inches, 0.05 inches and 0.06 inches, 0.06 inches and 0.07 inches, 0.07 inches and 0.08 inches, 0.08 inches and 0.09 inches, or 0.09 inches and 0.10 inches. In some embodiments, the CGx can be less than 0.10 inches, less than 0.09 inches, less than 0.08 inches, less than 0.07 inches, less than 0.06 inches, less than 0.05 inches, less than 0.04 inches, less than 0.03 inches, less than 0.02 inches, or less than 0.01 inches.

The CGy, as described above, is the position of the CG, relative to the y-axis, from the origin. In some embodiments, the CGy can be between 0.3 inches and 0.90 inches. In some embodiments, the CGy can be between 0.30 inches and 0.35 inches, 0.35 inches and 0.40 inches, 0.40 inches and 0.45 inches, 0.45 inches and 0.50 inches, 0.50 inches and 0.55 inches, 0.55 inches and 0.60 inches, 0.60 inches and 0.65 inches, 0.65 inches and 0.70 inches, 0.70 inches and 0.75 inches, 0.75 inches and 0.80 inches, 0.80 inches and 0.85 inches, or 0.85 inches and 0.90 inches.

The CGz, as described above, is the position of the CG, relative to the z-axis, from the origin. In some embodiments, the CGz can be between −0.35 and −1.10 inches. In some embodiments, the CGz can be between −0.35 inches and −0.40 inches, −0.40 inches and −0.45 inches, −0.45 inches and −0.50 inches, −0.50 inches and −0.55 inches, −0.55 inches and −0.60 inches, −0.60 inches and −0.65 inches, −0.65 inches and −0.70 inches, −0.70 inches and −0.75 inches, −0.75 inches and −0.80 inches, −0.80 inches and −0.85 inches, −0.85 inches and −0.90 inches, −0.90 inches and −0.95 inches, −0.95 inches and −1.00 inches, −1.00 inches and −1.05 inches, or −1.05 inches and −1.10 inches.

This further allows the blade style club head to achieve a MOIyy. The MOIyy has a direct correlation to the forgiveness of the blade style club head. A greater MOIyy provides a lesser probability of the blade type club head from twisting about the y-axis when the club head impacts the ball. More specifically, when the club head impacts the ball at a point on the face, other that its center, this increase in MOIyy prevents the club head from twisting resulting in a less than desirable putt (i.e. an offline putt).

The MOIyy can range from 800 $g*in^2$ to 1500 $g*in^2$. In some embodiments, the MOIyy can be between 800 $g*in^2$ and 850 $g*in^2$, 850 $g*in^2$ and 900 $g*in^2$, 900 $g*in^2$ and 950 $g*in^2$, 950 $g*in^2$ and 1000 $g*in^2$, 1000 $g*in^2$ and 1050 $g*in^2$, 1050 $g*in^2$ and 1100 $g*in^2$, 1100 $g*in^2$ and 1150 $g*in^2$, 1150 $g*in^2$ and 1200 $g*in^2$, 1200 $g*in^2$ and 1250 $g*in^2$, 1250 $g*in^2$ and 1300 $g*in^2$, 1300 $g*in^2$ and 1350 $g*in^2$, 1350 $g*in^2$ and 1400 $g*in^2$, 1400 $g*in^2$ and 1450 $g*in^2$, or 1450 $g*in^2$ and 1500 $g*in^2$. In some embodiments, the MOIyy can be greater than 800 $g*in^2$, greater than 900 $g*in^2$, greater than 1000 $g*in^2$, greater than 1100 $g*in^2$, greater than 1200 $g*in^2$, greater than 1300 $g*in^2$, or greater than 1400 $g*in^2$. In one exemplary embodiment the MOIyy is 1225 $g*in^2$. The blade style club head MOIyy, as described herein, can be up to 85% greater than a traditional blade style golf club head. Further, the blade style club head described herein can achieve up to approximately a 25% higher MOIyy when compared to a traditional mallet style golf club head. The increase in MOIyy prevents undesirable rotation about the y-axis and helps to ensure the strikeface is square at impact.

As discussed above the blade style club head can comprise a MOIxx ranging from 100 $g*in^2$ to 200 $g*in^2$. In some embodiments, the MOIxx can be between 100 $g*in^2$ and 125 $g*in^2$, 125 $g*in^2$ and 150 $g*in^2$, 150 $g*in^2$ and 175 $g*in^2$, or 175 $g*in^2$ and 200 $g*in^2$. In some embodiments, the MOIxx can be greater than 100 g*in$^2$ or greater than 200 g*in$^2$. In one exemplary embodiment, MOIxx is 135 g*in$^2$. The increase in the MOIxx prevents undesirable rotation about the x-axis.

Further, as discussed above, the blade style club head can comprise a MOIzz ranging from 800 g*in$^2$ to 1500 g*in$^2$. In some embodiments, the MOIzz can be between 800 g*in$^2$ and 850 g*in$^2$, 850 g*in$^2$ and 900 g*in$^2$, 900 g*in$^2$ and 950 g*in$^2$, 950 g*in$^2$ and 1000 g*in$^2$, 1000 g*in$^2$ and 1050 g*in$^2$, 1050 g*in$^2$ and 1100 g*in$^2$, 1100 g*in$^2$ and 1150 g*in$^2$, 1150 g*in$^2$ and 1200 g*in$^2$, 1200 g*in$^2$ and 1250 g*in$^2$, 1250 g*in$^2$ and 1300 g*in$^2$, 1300 g*in$^2$ and 1350 g*in$^2$, 1350 g*in$^2$ and 1400 g*in$^2$, 1400 g*in$^2$ and 1450 g*in$^2$, or 1450 g*in$^2$ and 1500 g*in$^2$. In some embodiments, the MOIzz can be greater than 800 g*in$^2$, greater than 900 g*in$^2$, greater than 1000 g*in$^2$, greater than 1100 g*in$^2$, greater than 1200 g*in$^2$, greater than 1300 g*in$^2$, or greater than 1400 g*in$^2$. In one exemplary embodiment, the MOIzz is 1225 g*in$^2$. The MOIzz is greater in the blade style club head, described herein, in comparison to a traditional blade style golf club head. The increase in the MOIzz prevents undesirable rotation about the z-axis and helps to ensure the desired spin is achieved.

The blade style club head can further comprise a MOIyy/CGz ratio. It is to be noted that this ratio displays the uniqueness of the blade style club head as described herein. The MOIyy/CGz of the blade style club head is much larger than the traditional blade putter, and further much larger than the traditional mallet putter. The traditional mallet putter has a higher MOIyy than a traditional blade putter. This has been achieved by increasing the depth of the putter. The blade style club head as described herein has achieved an even larger MOIyy by increasing the length as opposed to the depth. The increase of the length along with the addition of the perimeter weights, as described above, allows the blade style club head, to achieve a larger MOIyy/CGz ratio.

In some embodiments, the MOIyy/CGz ratio can be between 1600 and 2550. In some embodiments, the MOIyy/CGz ratio can between 1600 g*in and 1650 g*in, 1650 g*in and 1700 g*in, 1700 g*in and 1750 g*in, 1750 g*in and 1800 g*in, 1800 g*in and 1850 g*in, 1850 g*in and 1900 g*in, 1900 g*in and 1950 g*in, 1950 g*in and 2000 g*in, 2000 g*in and 2050 g*in, 2050 g*in and 2100 g*in, 2100 g*in and 2150 g*in, 2150 g*in and 2200 g*in, 2200 g*in and 2250 g*in, 2250 g*in and 2300 g*in, 2300 g*in and 2350 g*in, 2350 g*in and 2400 g*in, 2450 g*in and 2500 g*in, or 2500 g*in and 2550 g*in. In some embodiments, the MOIyy/CGz ratio can be greater than 1650 g*in, greater than 1750 g*in, greater than 1850 g*in, greater than 1950 g*in, greater than 2050 g*in, greater than 2150 g*in, greater than 2250 g*in, greater than 2350 g*in, greater than 2450, or greater than 2550 g*in.

As discussed above, the blade style club head described herein can achieve an approximately 85% higher MOIyy when compared to a traditional blade style golf club head. This can be attributed by the increased length as opposed to an increase in depth typically associated with a high MOI putter, such as a traditional mallet putter. Further, as discussed below in Example 3, the blade style club head described herein can achieve an approximately 23% higher MOIyy when compared to a traditional mallet style golf club head. The blade style club head can comprise a depth measured in a direction parallel to the z-axis. The depth can be between 1.25 inches and 2.00 inches. In some embodiments, the depth can be between 1.25 inches and 1.30 inches, 1.30 inches and 1.35 inches, 1.35 inches and 1.40 inches, 1.40 inches and 1.45 inches, 1.45 inches and 1.50 inches, between 1.50 inches and 1.55 inches, 1.55 inches and 1.60 inches, 1.60 inches and 1.65 inches, 1.65 inches and 1.70 inches, 1.70 inches and 1.75 inches, 1.75 inches and 1.80 inches, 1.80 inches and 1.85 inches, 1.85 inches and 1.90 inches, 1.90 inches and 1.95 inches, or 1.95 inches and 2.00 inches. In one exemplary embodiment, the depth is 1.650 inches.

In many embodiments, the blade style club head can further comprise a loft angle less than 10 degrees. In many embodiments, the loft angle of the blade style club head can be between 0 and 5 degrees, between 0 degrees and 6 degrees, between 0 degrees and 7 degrees, or between 0 degrees and 8 degrees. Further, the loft angle of the club head can be less than 10 degrees, less than 9 degrees, less than 8 degrees, less than 7 degrees, less than 6 degrees, or less than 5 degrees. For further example, the loft angle of the club head can be 0 degrees, 1 degree, 2 degrees, 3 degrees, 4 degrees, 5 degrees, 6 degrees, 7 degrees, 8 degrees, 9 degrees, or 10 degrees. The loft angle can be selected based on preferences of the player.

B. Other Features

1. Hosel

Furthermore, in some embodiments, the blade style club head can comprise a hosel attached to the heel. In such embodiments, the hosel can comprise a hosel geometry. The hosel geometry can be selected from a group consisting of: a plumber's neck, a slant neck, or a flow neck. In other embodiments, the blade style club head can comprise a hosel bore, as opposed to the hosel, as previously described. In such embodiments, the hosel bore can be positioned at the center of the blade style club head or at the heel of the blade style club head. In such embodiments, the hosel bore can receive a shaft with a tip end geometry selected from a group consisting of: a straight neck, a single bend, or a double bend.

Figure 8:
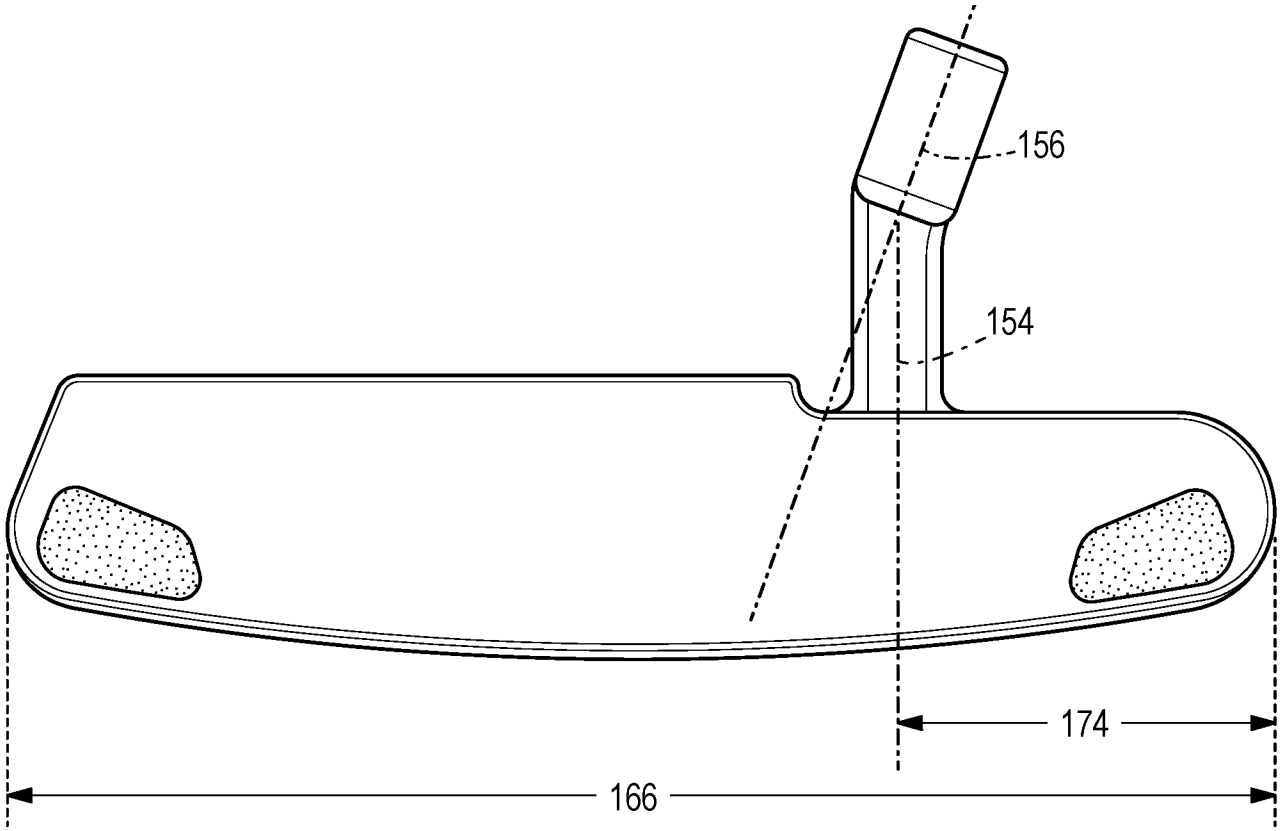
FIG. 8: illustrates a front view of the golf club of FIG. 7*a*.

As shown in FIG. 8 the hosel can comprise a hosel axis. The hosel axis can be concentric with the hosel or hosel bore, which is configured to receive and couple a golf shaft to the club head. The hosel axis can be parallel to the y-axis, and perpendicular to the x-axis. The hosel can be positioned a distance from the heel, hereafter referred to as "$D_h$". In some embodiments, the $D_h$ can be between 0.75 inches and 2.25 inches. In some embodiments, the $D_h$ can be between 0.75 inches and 1.00 inch, 1.00 inch and 1.25 inches, 1.25 inches and 1.50 inches, 1.50 inches and 1.75 inches, 1.75 inches and 2.00 inches, or 2.00 inches and 2.25 inches. The $D_h$ can ensure the hosel remains in the desired location relative to the sweet spot, and further ensures the blade style putter comprises the desired toe hang associated with a traditional blade style golf club head. The $D_h$ can also ensure the enlarged geometry, as discussed above, does not affect the desired feel or balance of the golf club during the swing.

2. Alignment Features

Figure 5:
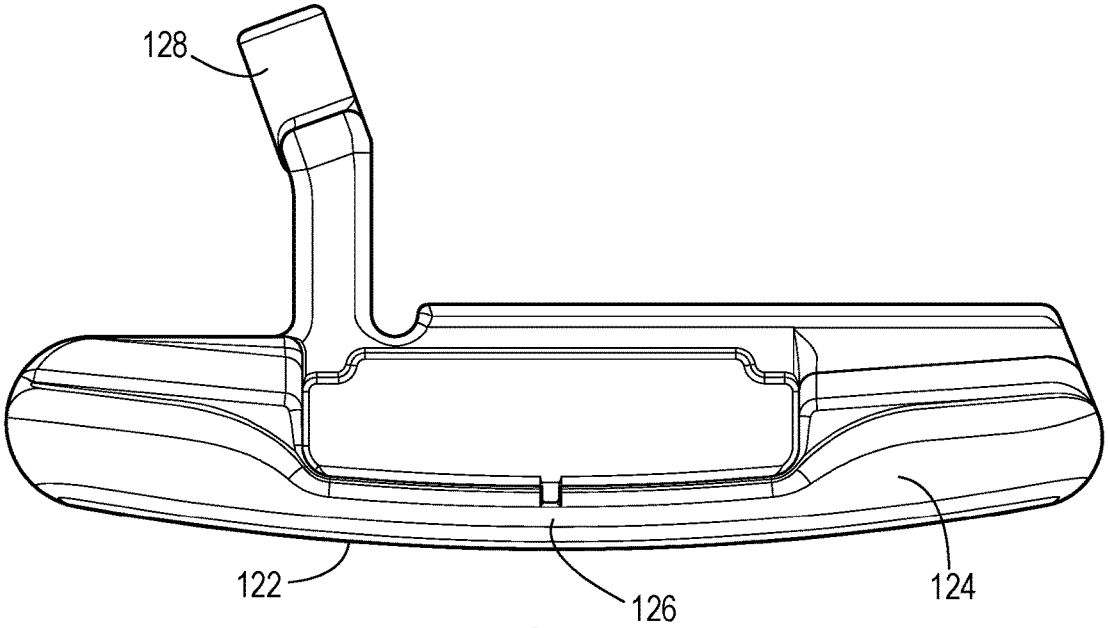
FIG. 5: illustrates a rear view of the golf club of FIG. 2.
Figure 6:
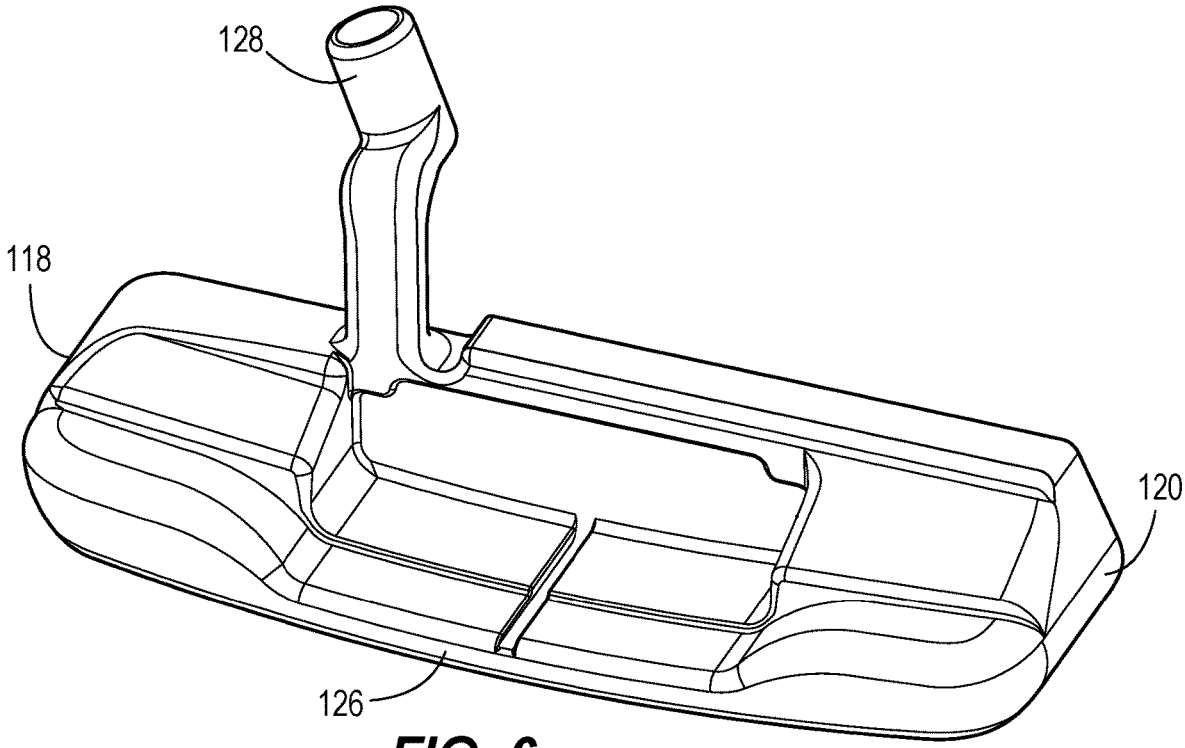
FIG. 6: illustrates an isometric view of the golf club of FIG. 2.

Further, as shown in FIGS. 5 and 6, the blade style club head can comprise an alignment feature. The alignment feature can be positioned on top of the blade style club head, such that the alignment feature can be seen at address. In many embodiments, the alignment feature can be centered on the GC plane. The alignment feature can be any one or combination of the following: a line, a circle, a dashed line, a triangle, a rectangle, a channel, a protrusion, or any other desired alignment feature. The alignment feature provides visual feedback as to whether the club head is properly aligned at address.

3. Materials—Strikeface

In some embodiments, the blade style club head can comprise a milled strikeface. In such embodiments, the strikeface is formed integrally with the blade style club head. In such embodiments the blade style club head can be formed of a single material or multiple materials. One or more portions of the club head can be formed by one or any combination of the following materials: 8620 alloy steel, S25C steel, carbon steel, maraging steel, 17-4 stainless steel, 303 stainless steel, 304 stainless-steel, stainless-steel alloy, tungsten, aluminum, aluminum alloy, ADC-12, or any metal suitable for creating a blade style club head.

Figure 14:
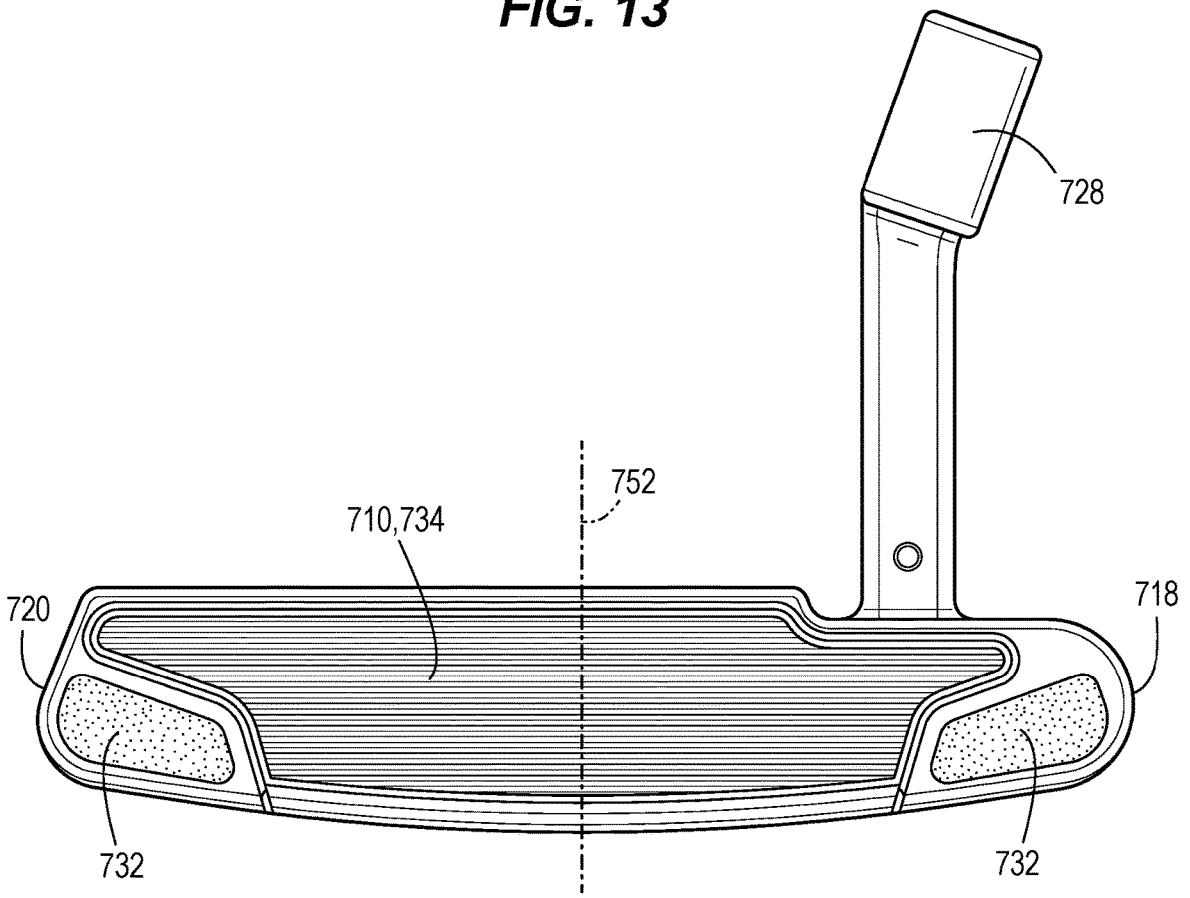
FIG. 14: illustrates a front view of the golf club according to a seventh embodiment.

In other embodiments, as illustrated in FIG. 14, the blade style club head can comprise a strikeface insert. In such embodiments, the strikeface insert is independently formed prior to being coupled to the blade style club head. In some embodiments, the strikeface insert can be made out of a material that is the same or similar to the blade style club head material. In other embodiments, the strikeface insert can be made of a material different from the blade style club head material. The strikeface can be secured by an adhesive such as glue, very high bond (VHB™) tape, epoxy, or another suitable adhesive. Alternately or additionally, the strikeface can be secured by welding, soldering, screws, rivets, pins, mechanical interlock structure, or another fastening method.

The strikeface insert can comprise any one or more, layered combinations of the following: aluminum, stainless steel, copper, thermoplastic co-polyester elastomer (TPC), thermoplastic elastomer (TPE), thermoplastic urethane (TPU), steel, nickel, TPU/aluminum, TPE/aluminum, plastic/metal screen insert, polyethylene, polypropylene, polytetrafluoroethylene, polyisobutylene, polyvinyl chloride, PEBAX®, or any other desired material. PEBAX® is a polyether block amide that is a thermoplastic elastomer made of a flexible polyether and rigid polyamide. The rigid polyamide can comprise Nylon. The PEBAX® can comprise different compounds that correspond to different Shore D hardness values, polyether percentages, and/or polyamide percentages. In many embodiments, the PEBAX® can comprise a PEBAX® 4033 (Arkema, Paris France) or a PEBAX® 6333 (Arkema, Paris France). The PEBAX® 4033 (Arkema, Paris France) comprises a tetramethylene oxide (53% wt) and a Nylon 12. The PEBAX® 6333 (Arkema, Paris France) comprises a Nylon 11. In some embodiments, the face insert can comprise a material such as steel, steel alloys, tungsten, tungsten alloys, aluminum, aluminum alloys, titanium, titanium alloys, vanadium, vanadium alloys, chromium, chromium alloys, cobalt, cobalt alloys, nickel, nickel alloys, other metals, other metal alloys, composite polymer materials, or any combination thereof. In some embodiments, the strikeface insert can comprise a single layer. In other embodiments, the strikeface insert can comprise two layers, three layers, four layers, or five layers. The use of the strikeface insert can allow designers to achieve a more forgiving putter with a softer feel and sound at impact.

5. Materials—Perimeter Weights

The perimeter weights can comprise any one or more combinations of the following: steel, steel alloys, tungsten alloys, vanadium, vanadium alloys, chromium, chromium alloys, cobalt, cobalt alloys, copper, nickel, nickel alloys, silver, lead, molybdenum, cadmium, bismuth, palladium, ruthenium, gold, protactinium, platinum, osmium, or tungsten. The perimeter weights can comprise a density between 8 g/cm$^3$ and 20 g/cm$^3$. In some embodiment the density can be greater than 8 g/cm$^3$, greater than 9 g/cm$^3$, greater than 10 g/cm$^3$, greater than 11 g/cm$^3$, greater than 12 g/cm$^3$, greater than 13 g/cm$^3$, greater than 14 g/cm$^3$, greater than 15 g/cm$^3$, greater than 16 g/cm$^3$, greater than 17 g/cm$^3$, greater than 18 g/cm$^3$, or greater than 19 g/cm$^3$.

5. Height

The blade style club head can comprise a height measured in a direction parallel to the Y-axis. The height can be between 0.90 inches and 1.55 inches. In some embodiments, the height can be between 0.90 inches and 1.00 inches, 1.00 inches and 1.10 inches, 1.10 inches and 1.15 inches, 1.15 inches and 1.20 inches, 1.25 inches and 1.30 inches, 1.30 inches and 1.35 inches, 1.45 inches and 1.50 inches, 1.40 inches and 1.45 inches, 1.45 inches and 1.50 inches, or 1.50 inches and 1.55 inches. In one exemplary embodiment, the height is 1.344 inches.

6. Volume

As discussed above, the blade style club head can comprise a volume. In many embodiments, the volume can range between 50 cc and 180 cc. In some embodiments, the club head volume can range between 50 cc and 55 cc, 55 cc and 60 cc, 60 cc and 65 cc, 65 cc and 70 cc, 70 cc and 75 cc, 75 cc and 80 cc, 80 cc and 85 cc, 85 cc and 90 cc, 90 cc and 95 cc, 95 cc and 100 cc, 100 cc and 105 cc, 105 cc and 110 cc, 110 cc and 115 cc, 115 cc and 120 cc, 120 cc and 125 cc, 125 cc and 130 cc, 130 cc and 135 cc, 135 cc and 140 cc, 140 cc and 145 cc, 145 cc and 150 cc, 150 cc and 155 cc, 155 cc and 160 cc, 160 cc and 165 cc, 165 cc and 170 cc, 170 cc and 175 cc, or 175 cc and 180 cc. In some embodiments, the club head volume can be greater than 50 cc, greater than 75 cc, greater than 100 cc, greater than 125 cc, or greater than 150 cc.

I. EXEMPLARY EMBODIMENT

A. Embodiment 1

Embodiment 1 is an improvement upon the design of a traditional blade style putter type golf club head (also referred to as "traditional blade style club head"). The simple geometric modifications made to arrive at the large blade style putter type club head (also referred to as "blade style club head") allow the embodiment to achieve better performance by incorporating the forgiveness typically associated with traditional mallet style putters into a blade style putter. Embodiment 1, a blade style club head, can accomplish these forgiving parameters as described above.

For ease of discussion, the blade style club head 100 is used to identify and locate the features discussed above, which are applicable to any embodiments of the blade style club head, in a first exemplary embodiment. The blade style club head 100 can comprises a strikeface 110 formed at a front of the body 108, a heel 118, a toe 120 opposite the heel 118, a rear 124 opposite the strikeface 110, rear wall 135 opposite the strikeface 110 a top rail 112 positioned adjacent to the strikeface 110 and adjacent to the rear wall 135, a sole 122 opposite the top rail 112, and a leading edge 130 adjacent the strikeface 110 and sole 122.

Figure 2:
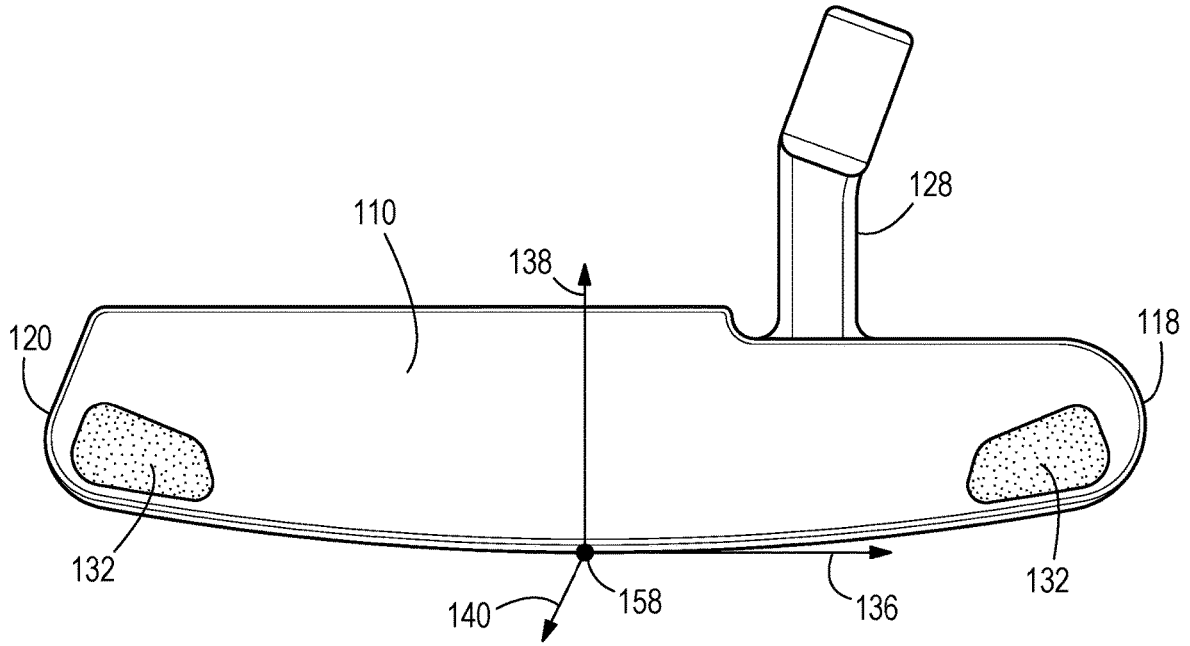
FIG. 2 illustrates a front view of the golf club according to a first embodiment.

As shown in FIG. 2, and as discussed above, the blade style club head 100 can comprise a XYZ coordinate system. The XYZ coordinate system can further comprise an origin 158 positioned on the leading edge 130 at the center of the strikeface 110. The XYZ coordinate system defines an x-axis 136, a y-axis 138, and a z-axis 140. The x-axis 136 extends through the origin 158 of the strikeface 110 in a direction from the heel 118 to the toe 120 of the blade style club head 100. The y-axis 138 extends through the origin of the strikeface 110 in a direction from the top rail 112 to the sole 122 of blade style club head 100. The y-axis 138 is perpendicular to the x-axis 136. The z-axis 140 extends through the origin of the strikeface 110 in a direction from the strikeface 110 to the rear 124 of the blade style club head 100. The z-axis 140 is perpendicular to both the x-axis 136 and the y-axis 138.

The blade style club head 100 can comprise a length 166. The length 166 is key to providing the forgiveness typically associated with a traditional mallet style putter type club head (also referred to as "mallet style club head"). The length 166 can be measured in a direction parallel to the x-axis 136 from the outer most point of the toe 120 to the outer most point of the heel 118. The length 166 can be between 5.00 inches and 7.00 inches. In some embodiments, the length 166 can be between 5.00 inches and 5.25 inches, 5.25 inches and 5.50 inches, 5.50 inches and 5.75 inches, 5.75 inches and 6.00 inches, 6.00 inches and 6.25 inches, 6.25 inches and 6.50 inches, 6.50 inches and 6.75 inches, or 6.75 inches and 7.00 inches. In one exemplary embodiment, the length 166 is 6.00 inches. The length 166 as described herein can allow for the ability to increase the MOI by moving mass away from the CG 148.

The blade style club head 100 can further comprise a total mass. The total mass of the blade style club head 100 can range between 320 grams and 325 grams, 325 grams and 330 grams, 330 grams and 335 grams, 335 grams and 340 grams, 340 grams and 345 grams, 345 grams and 350 grams, 350 grams and 355 grams, 355 grams and 360 grams, 360 grams and 365 grams, 365 grams and 370 grams, 370 grams and 375 grams, or 375 grams and 380 grams. In one exemplary embodiment, the total mass is 345 g. The total mass of the blade style club head 100 can have a direct effect on the control the player has on a putt and more specifically the control the player has over the speed of the putt.

As stated above, the addition of weights to the perimeter (the heel 118 and toe 120) of the blade style club head 100 can positively affect the MOI and CG. The blade style club head 100 can further comprise perimeter weights 132. In some embodiments, the perimeter weights 132 can be formed separately and coupled to the blade style club head. The perimeter weights 132 can be separately formed and coupled to the blade style club head 100 via welding, soldering, brazing, swaging, adhesion, epoxy, mechanical fastening, or any other suitable joining method. In some of these embodiments, one or more portion of the strikeface 110 can be machined out such that the perimeter weights 132 can be coupled to the blade style club head. The perimeter weights 132 can be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape. The perimeter weights 132 comprise tungsten.

Each of the perimeter weights 132 can comprise a mass. In some embodiments, the mass of each the perimeter weights 132 can be between 5 grams and 75 grams. In some embodiments, the mass of the perimeter weights 132 can be between 5 grams and 10 grams, 10 grams and 15 grams, 15 grams and 20 grams, 20 grams and 25 grams, 25 grams and 30 grams, 30 grams and 35 grams, 35 grams and 40 grams, 40 grams and 45 grams, 45 grams and 50 grams, 50 grams and 55 grams, 60 grams and 65 grams, 65 grams and 70 grams, or 70 grams and 75 grams.

The perimeter weights 132 can further comprise a plurality of toe weights and a plurality of heel weights. The plurality of toe weights can comprise one or more weights positioned toeward of the GC plane 152. In some embodiments, the plurality of toe weights can comprise 1 weight, 2 weights, 3 weights, 4 weights, or 5 weights. In one exemplary embodiment, the plurality of toe weights can comprise 1 weight. The plurality of heel weights can comprise one or more weights positioned heelward of the GC plane 152. In some embodiments, the plurality of heel weights can comprise 1 weight, 2 weights, 3 weights, 4 weights, or 5 weights. In one exemplary embodiment, the plurality of toe weights can comprise 1 weight. The addition of the perimeter weights 132 allows for a shift in weight, towards the periphery of the blade style club head, which can increase the MOI or forgiveness of the club head. The enlarged length further allows for the placement of the perimeter weights to be further away from the CG plane 152. The enlarged length further allows for the placement of the perimeter weights to be further away from the GC plane 152.

The perimeter weights 132 can further comprise a center of gravity (hereafter referred to as "the $CG_w$"). The $CG_w$ can be positioned a distance away from the CG. More specifically the position of the perimeter weights 132 can provide the greatest impact on the MOIyy 138. Therefore, the greater the distance of the $CG_w$ from the y-axis 138 the greater the increase of the MOIyy 138. In some embodiments, the distance y-axis 138 to the $CG_w$ can be between ±1.5 inches and ±3.5 inches. In some embodiments, the distance from the y-axis 138 to the $CG_w$ can be between ±1.50 inches and ±1.75 inches, ±1.75 inches and ±2.00 inches, 2.00 inches and ±2.25 inches, ±2.25 inches and ±2.50 inches, 2.50 inches and ±2.75 inches, 2.75 inches and ±3.00 inches, 3.00 inches and ±3.25 inches, or ±3.25 inches and ±3.50 inches. In some embodiments, the distance from the y-axis 138 to the $CG_w$ can be greater than ±1.50 inches, greater than ±1.75 inches, greater than ±2.00 inches, greater than ±2.25 inches, greater than ±2.50 inches, greater than ±2.75 inches, greater than ±3.00 inches, or greater than ±3.25 inches.

A percent of the total mass, of the blade style club head 100, is positioned outside (toeward or heelward) the first set of planes 182. In some embodiments, between 65% and 85% of the total mass is positioned outside the first set of planes 182. In some embodiments, the percentage of total mass positioned outside the first set of planes 182 is between 65% and 70%, 70% and 75%, 75% and 80%, or 80% and 85% of the total mass. In some embodiments, the percentage of the total mass of the club head positioned outside the first set of planes 182 is greater than 65%, greater than 70%, greater than 75%, greater than 80% or greater than 85%. In one exemplary embodiment, the percentage of mass positioned outside the first set of planes 182 is 75%.

A percent of the total mass, of the blade style club head 100, is positioned outside (toeward or heelward) the second set of planes 184. In some embodiments, between 45% and 65% of the total mass is positioned outside the second set of planes 184. In some embodiments, the percentage of mass positioned outside the second set of planes 184 is between 45% and 50%, 50% and 55%, 55% and 60%, or 60% and 65% of the total mass. In some embodiments, the percentage of mass of the clubhead positioned outside the second set of planes 184 is greater than 45%, greater than 50%, greater than 55%, greater than 60% or greater than 65%. In one exemplary embodiment, the percentage of the total mass positioned outside the second set of planes 184 is 58%.

A percent of the total mass, of the blade style club head 100, is positioned outside (toeward or heelward) the third set of planes 186 In some embodiments, between 30% and 50% of the total mass is positioned outside the third set of planes 186. In some embodiments, the percentage of mass positioned outside the third set of planes 186 is between 30% and 35%, 35% and 40%, 40% and 45%, or 45% and 50% of the total mass. In some embodiments, the percent of the total mass of the clubhead positioned outside the third set of planes 186 is greater than 30%, greater than 35%, greater than 40%, greater than 45% or greater than 50%. In one exemplary embodiment, the percentage of mass positioned outside the third set of planes 186 is 40%.

A percent of the total mass, of the blade style club head 100, is positioned outside (toeward or heelward) the fourth set of planes 188. In some embodiments, between 5% and 25% of the total mass is positioned outside the fourth set of planes 188. In some embodiments, the percentage of total mass positioned outside the fourth set of planes 188 is between 5% and 10%, 10% and 15%, 15% and 20%, or 20% and 25% of the total mass. In some embodiments, the percentage of total mass of the clubhead positioned outside the fourth set of planes 188 is greater than 5%, greater than 10%, greater than 15%, greater than 20% or greater than 25%. In one exemplary embodiment, the percentage of total mass positioned outside the fourth set of planes 188 is 17%.

The blade style club head 100 can comprise a depth 176, measured in a direction parallel to the z-axis 140. The depth 176 can be between 1.40 inches and 1.80 inches. In some embodiments, the depth 176 can be between 1.40 inches and 1.45 inches, 1.45 inches and 1.50 inches, 1.50 inches and 1.55 inches, 1.55 inches and 1.60 inches, 1.60 inches and 1.65 inches, 1.65 inches and 1.70 inches, 1.70 inches and 1.75 inches, and 1.75 inches and 1.80 inches. In one exemplary embodiment, the depth 176 is 1.650 inches.

The blade style club head 100 can comprise a height, measured in a direction parallel to the y-axis 138. The height 160 can be between 1.15 inches and 1.55 inches. In some embodiments, the height 160 can be between 1.15 inches and 1.20 inches, 1.25 inches and 1.30 inches, 1.30 inches and 1.35 inches, 1.45 inches and 1.50 inches, 1.40 inches and 1.45 inches, 1.45 inches and 1.50 inches, and 1.50 inches and 1.55 inches. In one exemplary embodiment, the height 160 is 1.344 inches.

In many embodiments, the blade style club head 100 can comprise a club head volume ranging between 50 cc and 180 cc. In some embodiments, the club head volume can range between 50 cc and 55 cc, 55 cc and 60 cc, 60 cc and 65 cc, 65 cc and 70 cc, 70 cc and 75 cc, 75 cc and 80 cc, 80 cc and 85 cc, 85 cc and 90 cc, 90 cc and 95 cc, 95 cc and 100 cc, 100 cc and 105 cc, 105 cc and 110 cc, 110 cc and 115 cc, 115 cc and 120 cc, 120 cc and 125 cc, 125 cc and 130 cc, 130 cc and 135 cc, 135 cc and 140 cc, 140 cc and 145 cc, 145 cc and 150 cc, 150 cc and 155 cc, 155 cc and 160 cc, 160 cc and 165 cc, 165 cc and 170 cc, 170 cc and 175 cc, or 175 cc and 180 cc. In some embodiments, the club head volume can be greater than 50 cc, greater than 75 cc, greater than 100 cc, greater than 125 cc, or greater than 150 cc.

The blade style club head 100 can comprise a moment of inertia (MOI) about the y-axis 138 (MOIyy) ranging from 800 g*in$^2$ to 1500 g*in$^2$. In some embodiments, the MOIyy can be between 800 g*in$^2$ and 825 g*in$^2$, 825 g*in$^2$ and 850 g*in$^2$, 850 g*in$^2$ and 875 g*in$^2$, 875 g*in$^2$ and 900 g*in$^2$, 900 g*in$^2$ and 925 g*in$^2$, 925 g*in$^2$ and 950 g*in$^2$, 950 g*in$^2$ and 975 g*in$^2$, 975 g*in$^2$ and 1000 g*in$^2$, 1000 g*in$^2$ and 1025 g*in$^2$, 1025 g*in$^2$ and 1050 g*in$^2$, 1050 g*in$^2$ and 1075 g*in$^2$, 1075 g*in$^2$ and 1100 g*in$^2$, 1100 g*in$^2$ and 1125 g*in$^2$, 1125 g*in$^2$ and 1150 g*in$^2$, 1150 g*in$^2$ and 1175 g*in$^2$, 1175 g*in$^2$ and 1200 g*in$^2$, 1200 g*in$^2$ and 1225 g*in$^2$, 1225 g*in$^2$ and 1250 g*in$^2$, 1250 g*in$^2$ and 1275 g*in$^2$, 1275 g*in$^2$ and 1300 g*in$^2$, 1300 g*in$^2$ and 1325 g*in$^2$, 1325 g*in$^2$ and 1450 g*in$^2$, 1350 g*in$^2$ and 1375 g*in$^2$, 1375 g*in$^2$ and 1400 g*in$^2$, 1400 g*in$^2$ and 1425 g*in$^2$, 1425 g*in$^2$ and 1450 g*in$^2$, 1450 g*in$^2$ and 1475 g*in$^2$, or 1475 g*in$^2$ and 1500 g*in$^2$. In some embodiments, the moment of inertia (MOI) about the y-axis 138 (MOIyy) can be greater than 800 g*in$^2$, greater than 900 g*in$^2$, greater than 1000 g*in$^2$, greater than 1100 g*in$^2$, greater than 1200 g*in$^2$, greater than 1300 g*in$^2$, or greater than 1400 g*in$^2$. In one exemplary embodiment, the moment of inertia (MOI) about the y-axis 138 (MOIyy) is 1225 g*in$^2$.

The blade style club head 100 can comprise a moment of inertia (MOI) about the x-axis 136 (MOIxx) ranging from 100 g*in$^2$ to 200 g*in$^2$. In some embodiments, the MOIxx can be between 100 g*in$^2$ and 125 g*in$^2$, 125 g*in$^2$ and 150 g*in$^2$, 150 g*in$^2$ and 175 g*in$^2$, or 175 g*in$^2$ and 200 g*in$^2$. In one exemplary embodiment, the moment of inertia (MOI) about the x-axis 136 (MOIxx) is 135 g*in$^2$.

The blade style club head 100 can comprise a moment of inertia (MOI) about the z-axis 140 (MOIzz) ranging from 800 g*in$^2$ to 1500 g*in$^2$. In some embodiments, the MOIzz can be between 800 g*in$^2$ and 825 g*in$^2$, 825 g*in$^2$ and 850 g*in$^2$, 850 g*in$^2$ and 875 g*in$^2$, 875 g*in$^2$ and 900 g*in$^2$, 900 g*in$^2$ and 925 g*in$^2$, 925 g*in$^2$ and 950 g*in$^2$, 950 g*in$^2$ and 975 g*in$^2$, 975 g*in$^2$ and 1000 g*in$^2$, 1000 g*in$^2$ and 1025 g*in$^2$, 1025 g*in$^2$ and 1050 g*in$^2$, 1050 g*in$^2$ and 1075 g*in$^2$, 1075 g*in$^2$ and 1100 g*in$^2$, 1100 g*in$^2$ and 1125 g*in$^2$, 1125 g*in$^2$ and 1150 g*in$^2$, 1150 g*in$^2$ and 1175 g*in$^2$, 1175 g*in$^2$ and 1200 g*in$^2$, 1200 g*in$^2$ and 1225 g*in$^2$, 1225 g*in$^2$ and 1250 g*in$^2$, 1250 g*in$^2$ and 1275 g*in$^2$, 1275 g*in$^2$ and 1300 g*in$^2$, 1300 g*in$^2$ and 1325 g*in$^2$, 1325 g*in$^2$ and 1450 g*in$^2$, 1350 g*in$^2$ and 1375 g*in$^2$, 1375 g*in$^2$ and 1400 g*in$^2$, 1400 g*in$^2$ and 1425 g*in$^2$, 1425 g*in$^2$ and 1450 g*in$^2$, 1450 g*in$^2$ and 1475 g*in$^2$, or 1475 g*in$^2$ and 1500 g*in$^2$.

The CGx, as described above, is the positioned of the CG 148, relative to the x-axis 136, from the origin 158. In some embodiments, the CGx can be between 0.00 inches and 0.10 inches. In some embodiments, the CGx can be between 0.00 inches and 0.01 inches, 0.01 inches and 0.02 inches, 0.02 inches and 0.03 inches, 0.03 inches and 0.04 inches, 0.04 inches and 0.05 inches, 0.05 inches and 0.06 inches, 0.06 inches and 0.07 inches, 0.07 inches and 0.08 inches, 0.08 inches and 0.09 inches, or 0.09 inches and 0.10 inches. In some embodiments, the CGx can be less than 0.10 inches, less than 0.09 inches, less than 0.08 inches, less than 0.07 inches, less than 0.06 inches, less than 0.05 inches, less than 0.04 inches, less than 0.03 inches, less than 0.02 inches, or less than 0.01 inches. In one exemplary embodiment, the CGx is 0.06 inches.

The CGy, as described above, is the position of the CG, relative to the Y-axis 138, from the origin 158. The CGy, as described above, is the position of the CG, relative to the Y-axis 138, from the origin 158. In some embodiments, the CGy can be between 0.3 inches and 0.90 inches. In some embodiments, the CGy can be between 0.30 inches and 0.35 inches, 0.35 inches and 0.40 inches, 0.40 inches and 0.45 inches, 0.45 inches and 0.50 inches, 0.50 inches and 0.55 inches, 0.55 inches and 0.60 inches, 0.60 inches and 0.65 inches, 0.65 inches and 0.70 inches, 0.70 inches and 0.75 inches, 0.75 inches and 0.80 inches, 0.80 inches and 0.85 inches, or 0.85 inches and 0.90 inches. In one exemplary embodiment, the CGy is 0.615 inches.

The CGz, as described above, is the position of the Cg, relative to the z-axis 140, from the origin 158. The CGz, as described above, is the position of the Cg, relative to the z-axis 140, from the origin 158. In some embodiments, the CGz can be between −0.35 and −1.10 inches. In some embodiments, the CGz can be between −0.35 inches and −0.40 inches, −0.40 inches and −0.45 inches, −0.45 inches and −0.50 inches, −0.50 inches and −0.55 inches, −0.55 inches and −0.60 inches, −0.60 inches and −0.65 inches, −0.65 inches and −0.70 inches, −0.70 inches and −0.75 inches, −0.75 inches and −0.80 inches, −0.80 inches and −0.85 inches, −0.85 inches and −0.90 inches, −0.90 inches and −0.95 inches, −0.95 inches and −1.00 inches, −1.00 inches and −1.05 inches, or −1.05 inches and −1.10 inches. In one exemplary embodiment, the CGz is −0.56 inches.

The blade style club head 100 can further comprise a MOIyy/CGz ratio. It is to be noted that this ratio displays the uniqueness of the blade style club head as described herein. The MOIyy/CGz of the blade style club head is much larger than the traditional blade putter, and further much larger than the traditional mallet putter. The traditional mallet putter has a higher MOIyy than a traditional blade putter. This has been achieved by increasing the depth of the putter. The blade style club head as described herein has achieved an even larger MOIyy by increasing the length as opposed to the depth.

The increase of the length along with the addition of the perimeter weights, as described above, allows the blade style club head, to achieve a larger MOIyy/CGz ratio. In some embodiments, the MOIyy/CGz ratio can be between 1600 g*in and 2550 g*in. In some embodiments, the MOIyy/CGz ratio can between 1600 g*in and 1650 g*in, 1650 g*in and 1700 g*in, 1700 g*in and 1750 g*in, 1750 g*in and 1800 g*in, 1800 g*in and 1850 g*in, 1850 g*in and 1900 g*in, 1900 g*in and 1950 g*in, 1950 g*in and 2000 g*in, 2000 g*in and 2050 g*in, 2050 g*in and 2100 g*in, 2100 g*in and 2150 g*in, 2150 g*in and 2200 g*in, 2200 g*in and 2250 g*in, 2250 g*in and 2300 g*in, 2300 g*in and 2350 g*in, 2350 g*in and 2400 g*in, 2450 g*in and 2500 g*in, or 2500 g*in and 2550 g*in. In some embodiments, the MOIyy/CGz ratio can be greater than 1650 g*in, greater than 1750 g*in, greater than 1850 g*in, greater than 1950 g*in, greater than 2050 g*in, greater than 2150 g*in, greater than 2250 g*in, greater than 2350 g*in, greater than 2450 g*in, or greater than 2550 g*in. In one exemplary embodiment, the MOIyy/CGz ratio can be 2052 g*in.

Figure 4:
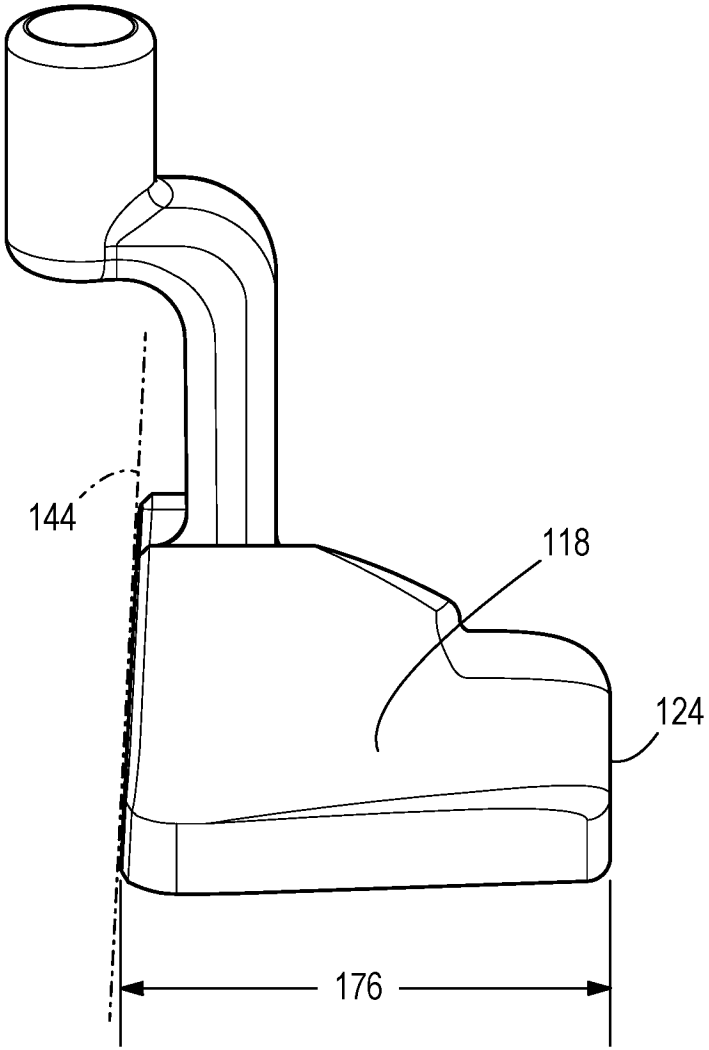
FIG. 4: illustrates a heel side view of the golf club of FIG. 2.
Figure 3:
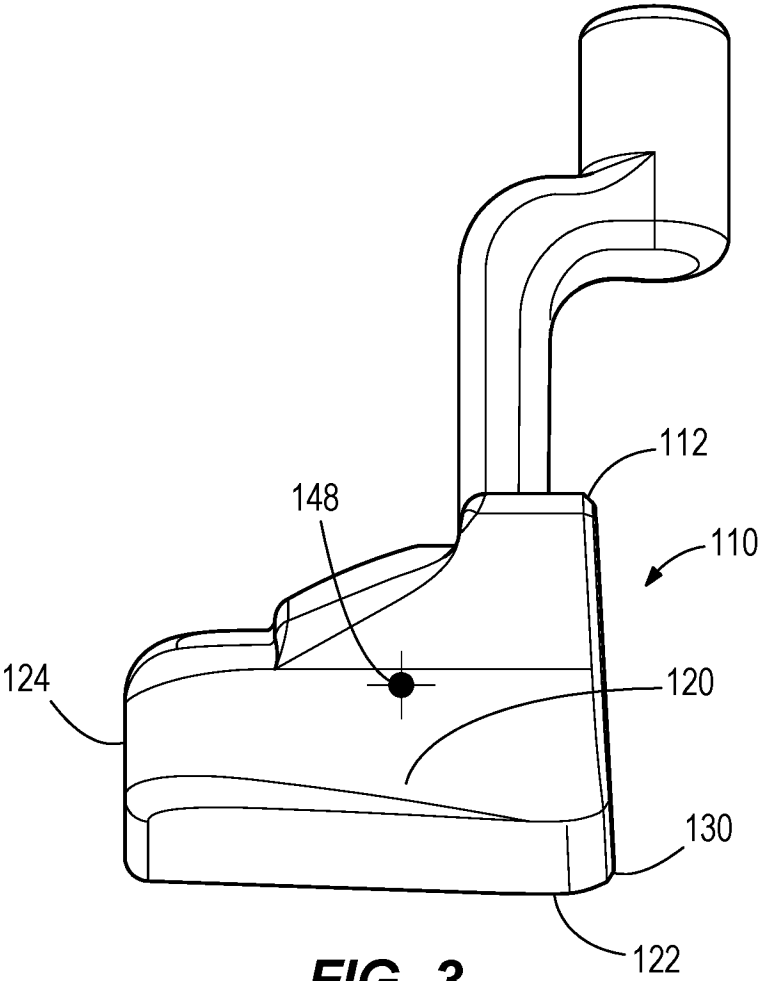
FIG. 3: illustrates a toe side view of the golf club of FIG. 2.

As shown in FIG. 4, the blade style club head 100 can further comprise a loft plane 144 and a loft angle. The loft angle is the angle between the loft angle and the y-axis 138. The loft angle is less than 10 degrees. In some embodiments, the loft angle of the blade style club head 100 can be between 0 degrees and 5 degrees, between 0 degrees and 6 degrees, between 0 degrees and 7 degrees, or between 0 degrees and 8 degrees. The loft angle of the club head 100 can be less than 10 degrees, less than 9 degrees, less than 8 degrees, less than 7 degrees, less than 6 degrees, or less than 5 degrees. The loft angle is selected based on the swing and preferences of the player.

As shown in FIG. 8, the blade style club head 100 can further comprise a hosel 128 attached to the top rail 112. The hosel 128 is positioned closer to the heel 118 than to the toe 120. The hosel geometry consists of a plumber's neck. The hosel 128 further comprises a hosel axis, wherein the hosel axis 154 is concentric with the hosel 128, parallel to the y-axis 138, and perpendicular to the x-axis 136. The hosel 128 is positioned a distance ($D_h$) 174 from the heel, wherein the $D_h$ 174 is the distance from the heel 118 to the hosel axis 154. In some embodiments, the $D_h$ 174 can be between 0.75 inches and 2.25 inches. In some embodiments, the $D_h$ 174 can be between 0.75 inches and 1.00 inch, 1.00 inch and 1.25 inches, 1.25 inches and 1.50 inches, 1.50 inches and 1.75 inches, 1.75 inches and 2.00 inches, or 2.00 inches and 2.25 inches. The $D_h$ 174 can ensure the hosel 128 remains in the desired location relative to the sweet spot. The $D_h$ 174 can also ensure the enlarged geometry, as further discussed below, does not affect the desired feel or balance of the golf club during the swing.

Referring to FIG. 6, the blade style club head 100 further comprises an alignment feature 126, comprising a single recess that extends perpendicular to the strikeface 110, from the rear wall 135 to the rear 124. The alignment feature 126 is centered on the GC plane 125. The alignment feature 126 assists primarily in focusing the player on the location of face center 150 at address.

B. Embodiment 2

Figure 9:
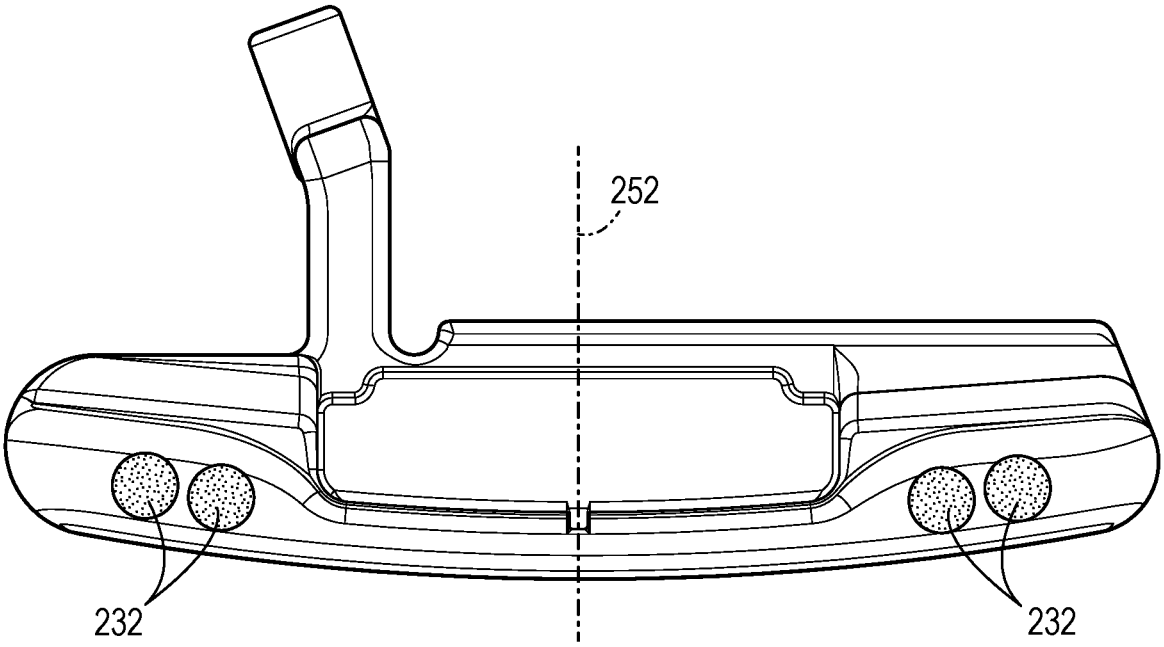
FIG. 9: illustrates a rear view of the golf club according to a second embodiment.

Referring to FIG. 9, in other embodiments, a blade style club head 200 can comprise similar features to blade style club head 100. Specifically the blade style club head 200 can comprise comprises a similar strikeface (110, 210) formed at a front of the body (108, 208), a heel (118, 218), a toe (120, 220) opposite the heel (118, 218), a rear (124, 224) opposite the strike face (110, 210), a rear wall (125, 225) opposite the strike face (110, 210) a top rail (112, 212) positioned adjacent to the strikeface (110, 210) and adjacent to the rear wall (125, 225), a sole (122, 222) opposite the top rail (112, 212), and a leading edge (130, 230) adjacent the strike face (110, 210) and sole (122, 222). Further, blade style club head 200 can comprise a similar length, height, depth, mass, and volume as blade style club head 100.

In comparison to Embodiment 1, depicted in FIG. 2, the blade style club head 200 comprises different perimeter weights. As shown in FIG. 9 the perimeter weights 232 comprise 4 cylindrical shaped weights positioned in line with one another relative to the x-axis. Further, the perimeter weights 232 are positioned on the rear proximal the sole. The perimeter weight 232 can be positioned with 0.50 inches of the sole and within 1.0 inch of the heel and toe. The position of the perimeter weights 232 can allow for a low and rearwardly positioned CG.

The perimeter weights 232 can further comprise a plurality of toe weights and a plurality of heel weights. The plurality of toe weights can comprise 2 weights positioned toeward of the GC plane 252. The plurality of heel weights can comprise 2 weights positioned heelward of the GC plane 252.

Each of the perimeter weights 232 can comprise a mass. In some embodiments, the mass of the perimeter weights 132 can be between 5 grams and 75 grams. In some embodiments, the mass of the perimeter weights 132 can be between 5 grams and 10 grams, 10 grams and 15 grams, 15 grams and 20 grams, 20 grams and 25 grams, 25 grams and 30 grams, 30 grams and 35 grams, 35 grams and 40 grams, 40 grams and 45 grams, 45 grams and 50 grams, 50 grams and 55 grams, 60 grams and 65 grams, 65 grams and 70 grams, or 70 grams and 75 grams. The perimeter weights 232 comprise tungsten.

The addition of the perimeter weights 232 allows for a shift in weight, towards the periphery of the blade style club head, which can increase the MOI or forgiveness of the club head. The perimeter weights 232 can further comprise a center of gravity (hereafter referred to as "the $CG_w$"). The $CG_w$ can be positioned a distance away from the CG. More specifically the position of the perimeter weights 232 can provide the greatest impact on the MOIy. Therefore, the greater the distance of the $CG_w$ from the y-axis the greater the increase of the MOIyy. In some embodiments, the distance y-axis to the $CG_w$ can be between ±1.5 inches and ±3.5 inches. In some embodiments, the distance from the y-axis to the $CG_w$ can be between ±1.50 inches and ±1.75 inches, ±1.75 inches and ±2.00 inches, 2.00 inches and ±2.25 inches, ±2.25 inches and ±2.50 inches, 2.50 inches and ±2.75 inches, 2.75 inches and ±3.00 inches, 3.00 inches and ±3.25 inches, or ±3.25 inches and ±3.50 inches. In some embodiments, the distance from the y-axis 138 to the $CG_w$ can be greater than ±1.50 inches, greater than ±1.75 inches, greater than ±2.00 inches, greater than ±2.25 inches, greater than ±2.50 inches, greater than ±2.75 inches, greater than ±3.00 inches, or greater than ±3.25 inches.

A percent of the total mass is positioned outside (toeward or heelward) the first set of planes. In some embodiments, between 65% and 85% of the total mass is positioned outside the first set of planes. In some embodiments, the percentage of total mass positioned outside the first set of planes is between 65% and 70%, 70% and 75%, 75% and 80%, or 80% and 85% of the total mass. In some embodiments, the percentage of the total mass of the club head positioned outside the first set of planes is greater than 65%, greater than 70%, greater than 75%, greater than 80% or greater than 85%.

A percent of the total mass is positioned outside (toeward or heelward) the second set of planes. In some embodiments, between 50% and 70% of the total mass is positioned outside the second set of planes. In some embodiments, the percentage of total mass positioned outside the second set of planes is between 50% and 55%, 55% and 60%, 60% and 65%, or 65% and 70% of the total mass. In some embodiments, the percentage of the total mass of the club head positioned outside the second set of planes is greater than 50%, greater than 55%, greater than 60%, or greater than 65%.

A percent of the total mass is positioned outside (toeward or heelward) the third set of planes. In some embodiments, between 25% and 55% of the total mass is positioned outside the third set of planes. In some embodiments, the percentage of total mass positioned outside the third set of planes is between 25% and 35%, 35% and 45%, or 45% and 55% of the total mass. In some embodiments, the percent of the total mass of the clubhead positioned outside the third set of planes is greater than 25%, greater than 35%, greater than 45%, or greater than 55%.

A percent of the total mass is positioned outside (toeward or heelward) the fourth set of planes. In some embodiments, between 5% and 25% of the total mass is positioned outside the fourth set of planes. In some embodiments, the percentage of total mass positioned outside the fourth set of planes is between 5% and 10%, 10% and 15%, 15% and 20%, or 20% and 25% of the total mass. In some embodiments, the percentage of total mass of the clubhead positioned outside the fourth set of planes is greater than 5%, greater than 10%, greater than 15%, greater than 20% or greater than 25%.

C. Embodiment 3

Figure 10:
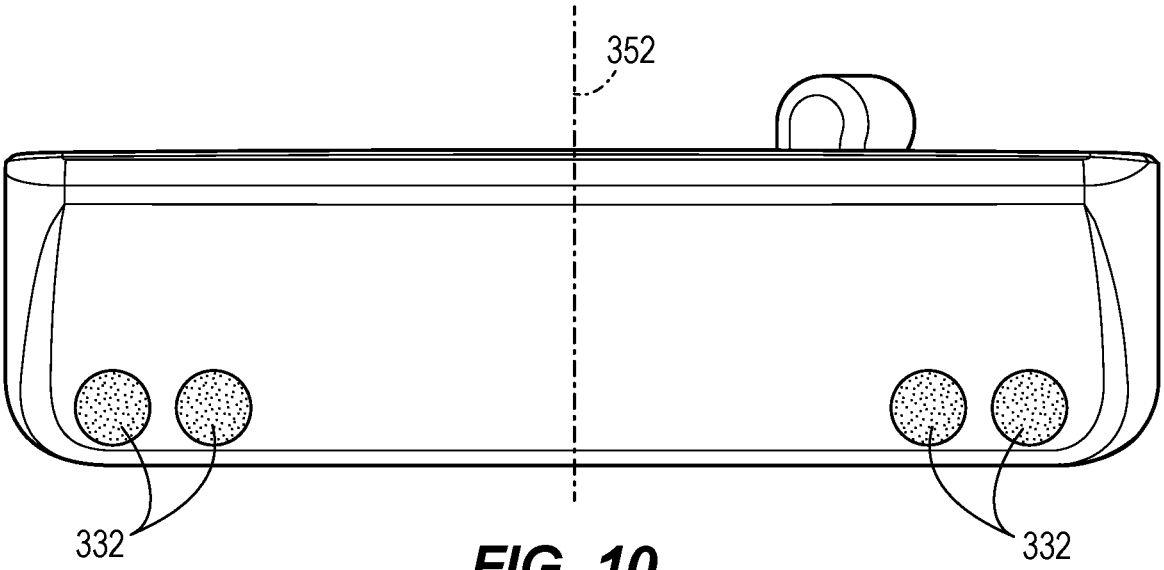
FIG. 10: illustrates a bottom view of the golf club according to a third embodiment.

Referring to FIG. 10, in other embodiments, a blade style club head 300 can comprise similar features to blade style club head 100. Specifically the blade style club head 300 can comprise comprises a similar strikeface (110, 310) formed at a front of the body (108, 308), a heel (118, 318), a toe (120, 320) opposite the heel (118, 318), a rear (124, 324) opposite the strike face (110, 310), a rear wall (125, 325) opposite the strike face (110, 310) a top rail (112, 312) positioned adjacent to the strikeface (110, 310) and adjacent to the rear wall (125, 325), a sole (122, 322) opposite the top rail (112, 312), and a leading edge (130, 330) adjacent the strike face (110, 310) and sole (122, 322). Further, blade style club head 300 can comprise a similar length, height, depth, mass, and volume as blade style club head 100.

In comparison to Embodiment 1, depicted in FIG. 2, the blade style club head 300 comprises different perimeter weights. As shown in FIG. 10 the perimeter weights 332 comprise 4 cylindrical shaped weights positioned on the in line with one another relative to the x-axis. Further the perimeter weights 332 are positioned on the sole, proximal the rear. The perimeter weight 332 can be positioned with 0.50 inches of the rear and within 1.0 inch of the heel and toe. The position of the perimeter weights 332 can allow for a low and rearwardly positioned CG.

The perimeter weights 332 can further comprise a plurality of toe weights and a plurality of heel weights. The plurality of toe weights can comprise 2 weights positioned toeward of the GC plane 352. The plurality of heel weights can comprise 2 weights positioned heelward of the GC plane 352.

Each of the perimeter weights 332 can comprise a mass. In some embodiments, the mass of the perimeter weights 332 can be between 5 grams and 75 grams. In some embodiments, the mass of each perimeter weights 332 can be between 5 grams and 10 grams, 10 grams and 15 grams, 15 grams and 20 grams, 20 grams and 25 grams, 25 grams and 30 grams, 30 grams and 35 grams, 35 grams and 40 grams, 40 grams and 45 grams, 45 grams and 50 grams, 50 grams and 55 grams, 60 grams and 65 grams, 65 grams and 70 grams, or 70 grams and 75 grams. The perimeter weights 332 comprise tungsten.

The addition of the perimeter weights 332 allows for a shift in weight, towards the periphery of the blade style club head, which can increase the MOI or forgiveness of the club head. The perimeter weights 332 can further comprise a center of gravity (hereafter referred to as "the $CG_w$"). The $CG_w$ can be positioned a distance away from the CG. More specifically the position of the perimeter weights 332 can provide the greatest impact on the MOIyy. Therefore, the greater the distance of the $CG_w$ from the y-axis the greater the increase of the MOIyy. In some embodiments, the distance y-axis to the $CG_w$ can be between ±1.5 inches and ±3.5 inches. In some embodiments, the distance from the y-axis to the $CG_w$ can be between ±1.50 inches and ±1.75 inches, ±1.75 inches and ±2.00 inches, 2.00 inches and ±2.25 inches, ±2.25 inches and ±2.50 inches, 2.50 inches and ±2.75 inches, 2.75 inches and ±3.00 inches, 3.00 inches and ±3.25 inches, or ±3.25 inches and ±3.50 inches. In some embodiments, the distance from the y-axis 138 to the $CG_w$ can be greater than ±1.50 inches, greater than ±1.75 inches, greater than ±2.00 inches, greater than ±2.25 inches, greater than ±2.50 inches, greater than ±2.75 inches, greater than ±3.00 inches, or greater than ±3.25 inches.

A percent of the total mass is positioned outside (toeward or heelward) the first set of planes. In some embodiments, between 65% and 85% of the total mass is positioned outside the first set of planes. In some embodiments, the percentage of total mass positioned outside the first set of planes is between 65% and 70%, 70% and 75%, 75% and 80%, or 80% and 85% of the total mass. In some embodiments, the percentage of the total mass of the club head positioned outside the first set of planes is greater than 65%, greater than 70%, greater than 75%, greater than 80% or greater than 85%.

A percent of the total mass is positioned outside (toeward or heelward) the second set of planes. In some embodiments, between 50% and 70% of the total mass is positioned outside the second set of planes. In some embodiments, the percentage of total mass positioned outside the second set of planes is between 50% and 55%, 55% and 60%, 60% and 65%, or 65% and 70% of the total mass. In some embodiments, the percentage of the total mass of the club head positioned outside the second set of planes is greater than 50%, greater than 55%, greater than 60%, or greater than 65.

A percent of the total mass is positioned outside (toeward or heelward) the third set of planes. In some embodiments, between 25% and 55% of the total mass is positioned outside the third set of planes. In some embodiments, the percentage of total mass positioned outside the third set of planes is between 25% and 35%, 35% and 45%, or 45% and 55% of the total mass. In some embodiments, the percent of the total mass of the clubhead positioned outside the third set of planes is greater than 25%, greater than 35%, greater than 45%, or greater than 55%.

A percent of the total mass is positioned outside (toeward or heelward) the fourth set of planes. In some embodiments, between 5% and 25% of the total mass is positioned outside the fourth set of planes. In some embodiments, the percentage of total mass positioned outside the fourth set of planes is between 5% and 10%, 10% and 15%, 15% and 20%, or 20% and 25% of the total mass. In some embodiments, the percentage of total mass of the clubhead positioned outside the fourth set of planes is greater than 5%, greater than 10%, greater than 15%, greater than 20% or greater than 25%.

D. Embodiment 4

Referring to FIG. 11, in other embodiments, a blade style club head 400 can comprise similar features to blade style club head 100. Specifically the blade style club head 400 can comprise comprises a similar strikeface (110, 410) formed at a front of the body (108, 408), a heel (118, 418), a toe (120, 420) opposite the heel (118, 418), a rear (124, 424) opposite the strike face (110, 410), a rear wall (125, 425) opposite the strike face (110, 410) a top rail (112, 412) positioned adjacent to the strikeface (110, 410) and adjacent to the rear wall (125, 425), a sole (122, 422) opposite the top rail (112, 412), and a leading edge (130, 430) adjacent the strike face (110, 410) and sole (122, 422). Further, blade style club head 400 can comprise a similar length, height, depth, mass, and volume as blade style club head 100.

In comparison to Embodiment 1, depicted in FIG. 2, the blade style club head 400 comprises different perimeter weights. As shown in FIG. 11 the perimeter weights 432 comprise 4 cylindrical shaped weights positioned on the in line with one another relative to the x-axis. Further the perimeter weights 432 are positioned on the sole, proximal the rear. The perimeter weight 432 comprises a single bar weight that makes up a portion of the rear. The position of the perimeter weights 432 can allow for a low and rearwardly positioned CG.

Each of the perimeter weight 432 can comprise a mass. In some embodiments, the mass of the perimeter weights 432 can be between 25 grams and 75 grams. In some embodiments, the mass of each perimeter weights 332 can be between 25 grams and 30 grams, 30 grams and 35 grams, 35 grams and 40 grams, 40 grams and 45 grams, 45 grams and 50 grams, 50 grams and 55 grams, 60 grams and 65 grams, 65 grams and 70 grams, or 70 grams and 75 grams. The perimeter weights 432 comprise tungsten.

The addition of the perimeter weight 432 allows for a shift in weight, towards the periphery of the blade style club head, which can increase the MOI or forgiveness of the club head. The perimeter weight 432 can further comprise a center of gravity (hereafter referred to as "the $CG_w$"). The $CG_w$ can be positioned a distance away from the CG. More specifically the position of the perimeter weights 332 can provide the greatest impact on the MOIyy. Therefore, the greater the distance of the $CG_w$ from the y-axis the greater the increase of the MOIyy. In some embodiments, the distance y-axis to the $CG_w$ can be between ±0.00 inches and ±3.50 inches. In some embodiments, the distance from the y-axis to the $CG_w$ can be between 0.00 inches and ±0.25 inches, ±0.25 inches and ±0.50 inches, 0.50 inches and ±0.75 inches, 0.75 inches and ±1.00 inches, 1.00 inches and ±1.25 inches, ±1.25 inches and ±1.50 inches, ±1.50 inches and ±1.75 inches, ±1.75 inches and ±2.00 inches, 2.00 inches and ±2.25 inches, ±2.25 inches and ±2.50 inches, 2.50 inches and ±2.75 inches, 2.75 inches and ±3.00 inches, 3.00 inches and ±3.25 inches, or ±3.25 inches and ±3.50 inches. In some embodiments, the distance from the y-axis 138 to the $CG_w$ can be greater than ±0.50 inches greater than ±1.00 inches, greater than ±1.50 inches, greater than ±2.00 inches, greater than ±2.50 inches, greater than ±3.00 inches, or greater than ±3.50 inches.

A percent of the total mass is positioned outside (toeward or heelward) the first set of planes. In some embodiments, between 65% and 85% of the total mass is positioned outside the first set of planes. In some embodiments, the percentage of total mass positioned outside the first set of planes is between 65% and 70%, 70% and 75%, 75% and 80%, or 80% and 85% of the total mass. In some embodiments, the percentage of the total mass of the club head positioned outside the first set of planes is greater than 65%, greater than 70%, greater than 75%, greater than 80% or greater than 85%.

A percent of the total mass is positioned outside (toeward or heelward) the second set of planes. In some embodiments, between 45% and 65% of the total mass is positioned outside the second set of planes. In some embodiments, the percentage of total mass positioned outside the second set of planes is between 45% and 50%, 50% and 55%, 55% and 60%, or 60% and 65% of the total mass. In some embodiments, the percentage of the total mass of the club head positioned outside the second set of planes is greater than 45%, greater than 50%, greater than 55%, greater than 60%, or greater than 65%.

A percent of the total mass is positioned outside (toeward or heelward) the third set of planes. In some embodiments, between 25% and 55% of the total mass is positioned outside the third set of planes. In some embodiments, the percentage of total mass positioned outside the third set of planes is between 25% and 30%, 30% and 35%, 35% and 40%, 40% and 45%, 45% and 50%, or 50% and 55% of the total mass. In some embodiments, the percentage of the total mass of the club head positioned outside the third set of planes is greater than 25%, greater than 35%, greater than 45%, or greater than 55%.

A percent of the total mass is positioned outside (toeward or heelward) the fourth set of planes. In some embodiments, between 5% and 25% of the total mass is positioned outside the fourth set of planes. In some embodiments, the percentage of total mass positioned outside the fourth set of planes is between 5% and 10%, 10% and 15%, 15% and 20%, or 20% and 25% of the total mass. In some embodiments, the percentage of total mass of the clubhead positioned outside the fourth set of planes is greater than 5%, greater than 10%, greater than 15%, greater than 20% or greater than 25%.

E. Embodiment 5

Figure 12:
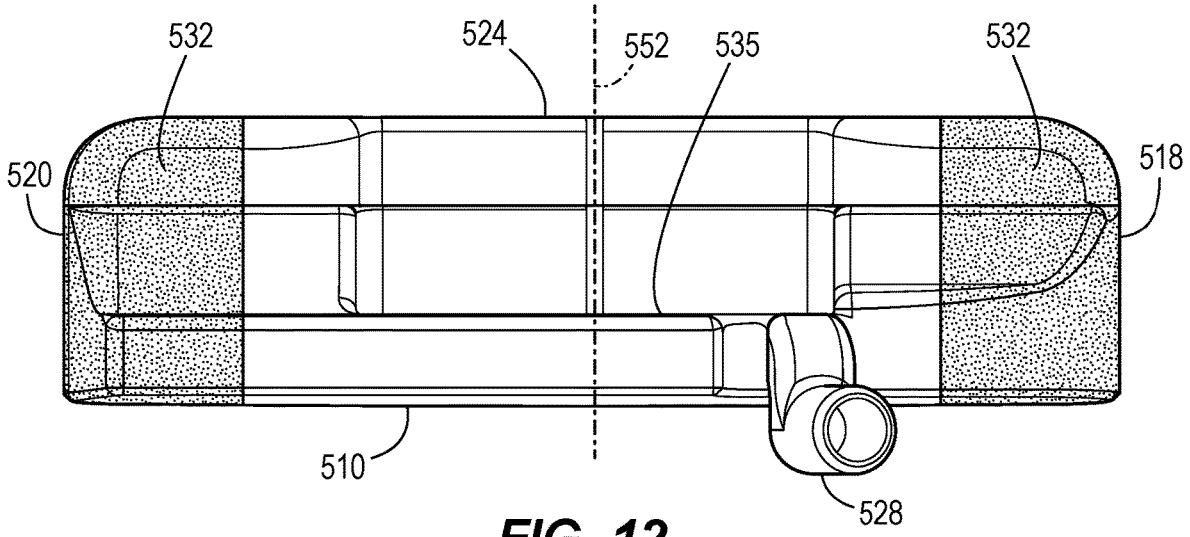
FIG. 12: illustrates a top view of the golf club according to a fifth embodiment.

Referring to FIG. 12, in other embodiments a blade style club head 500 can comprise similar features to blade style club head 100. Specifically the blade style club head 500 can comprise comprises a similar (110, 510) formed at a front of the body (108, 508), a heel (118, 518), a toe (120, 520) opposite the heel (118, 518), a rear (124, 524) opposite the strike face (110, 510), a rear wall (125, 525) opposite the strike face (110, 510) a top rail (112, 512) positioned adjacent to the strikeface (110, 510) and adjacent to the rear wall (125, 525), a sole (122, 522) opposite the top rail (112, 512), and a leading edge (130, 530) adjacent the strike face (110, 510) and sole (122, 522). Further, blade style club head 500 can comprise a similar length, height, depth, mass, and volume as blade style club head 100.

In comparison to Embodiment 1, depicted in FIG. 2, the blade style club head 500 comprises different perimeter weights. As shown in FIG. 12 perimeter weights 532 make up a portion of heel and a portion of the toe. The position of the perimeter weights 532 can allow for the majority of the mass to be positioned as far from the CG as possible, increasing the MOIyy.

Each of the perimeter weights 532 can comprise a mass. In some embodiments, the mass of the perimeter weights 532 can be between 20 grams and 75 grams. In some embodiments, the mass of each perimeter weights 532 can be between 20 grams and 25 grams, 25 grams and 30 grams, 30 grams and 35 grams, 35 grams and 40 grams, 40 grams and 45 grams, 45 grams and 50 grams, 50 grams and 55 grams, 60 grams and 65 grams, 65 grams and 70 grams, or 70 grams and 75 grams. The perimeter weights 532 comprise tungsten.

The addition of the perimeter weights 532 allows for a shift in weight, towards the periphery of the blade style club head, which can increase the MOI or forgiveness of the club head. The perimeter weights 532 can further comprise a center of gravity (hereafter referred to as "the $CG_w$"). The $CG_w$ can be positioned a distance away from the CG. More specifically the position of the perimeter weights 532 can provide the greatest impact on the MOIyy. Therefore, the greater the distance of the $CG_w$ from the y-axis the greater the increase of the MOIyy. In some embodiments, the distance y-axis to the $CG_w$ can be between ±1.5 inches and ±3.5 inches. In some embodiments, the distance from the y-axis to the $CG_w$ can be between ±1.50 inches and ±1.75 inches, ±1.75 inches and ±2.00 inches, 2.00 inches and ±2.25 inches, ±2.25 inches and ±2.50 inches, 2.50 inches and ±2.75 inches, 2.75 inches and ±3.00 inches, 3.00 inches and ±3.25 inches, or ±3.25 inches and ±3.50 inches. In some embodiments, the distance from the y-axis 138 to the $CG_w$ can be greater than ±1.50 inches, greater than ±1.75 inches, greater than ±2.00 inches, greater than ±2.25 inches, greater than ±2.50 inches, greater than ±2.75 inches, greater than ±3.00 inches, or greater than ±3.25 inches.

A percent of the total mass is positioned outside (toeward or heelward) the first set of planes. In some embodiments, between 65% and 85% of the total mass is positioned outside the first set of planes. In some embodiments, the percentage of total mass positioned outside the first set of planes is between 65% and 70%, 70% and 75%, 75% and 80%, or 80% and 85% of the total mass. In some embodiments, the percentage of the total mass of the club head positioned outside the first set of planes is greater than 65%, greater than 70%, greater than 75%, greater than 80% or greater than 85%.

A percent of the total mass is positioned outside (toeward or heelward) the second set of planes. In some embodiments, between 50% and 70% of the total mass is positioned outside the second set of planes. In some embodiments, the percentage of total mass positioned outside the second set of planes is between 50% and 55%, 55% and 60%, 60% and 65%, or 65% and 70% of the total mass. In some embodiments, the percentage of the total mass of the club head positioned outside the second set of planes is greater than 50%, greater than 55%, greater than 60%, or greater than 65.

A percent of the total mass is positioned outside (toeward or heelward) the third set of planes. In some embodiments, between 25% and 55% of the total mass is positioned outside the third set of planes. In some embodiments, the percentage of total mass positioned outside the third set of planes is between 25% and 35%, 35% and 45%, or 45% and 55% of the total mass. In some embodiments, the percent of the total mass of the clubhead positioned outside the third set of planes is greater than 25%, greater than 35%, greater than 45%, or greater than 55%.

A percent of the total mass is positioned outside (toeward or heelward) the fourth set of planes. In some embodiments, between 5% and 25% of the total mass is positioned outside the fourth set of planes. In some embodiments, the percentage of total mass positioned outside the fourth set of planes is between 5% and 10%, 10% and 15%, 15% and 20%, or 20% and 25% of the total mass. In some embodiments, the percentage of total mass of the clubhead positioned outside the fourth set of planes is greater than 5%, greater than 10%, greater than 15%, greater than 20% or greater than 25%.

A percent of the total mass is positioned outside (toeward or heelward) the fourth set of planes. In some embodiments, between 5% and 25% of the total mass is positioned outside the fourth set of planes. In some embodiments, the percentage of total mass positioned outside the fourth set of planes is between 5% and 10%, 10% and 15%, 15% and 20%, or 20% and 25% of the total mass. In some embodiments, the percentage of total mass of the clubhead positioned outside the fourth set of planes is greater than 5%, greater than 10%, greater than 15%, greater than 20% or greater than 25%.

F. Embodiment 6

Figure 13:
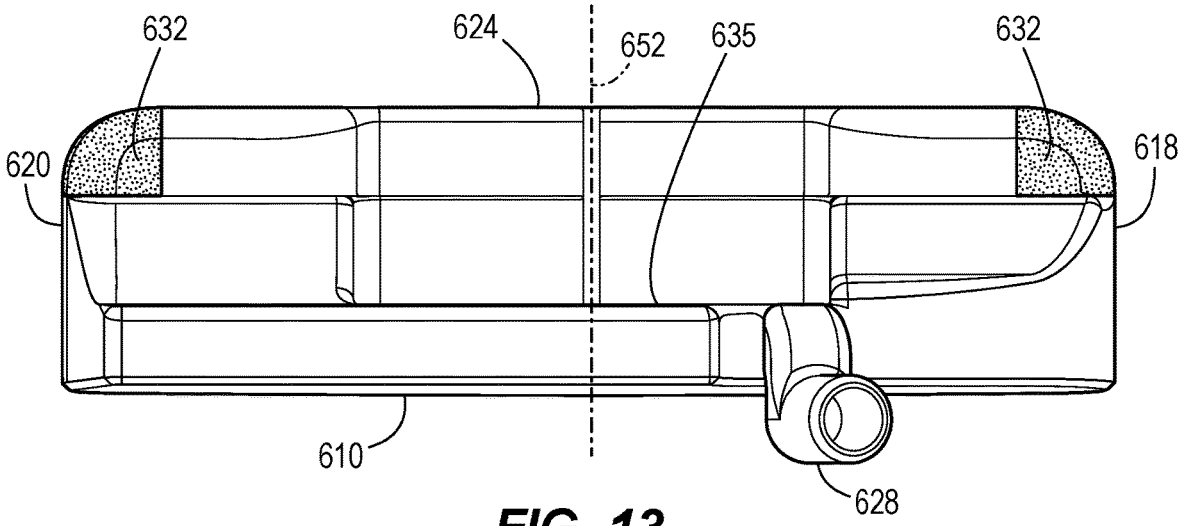
FIG. 13: illustrates a top view of the golf club according to a sixth embodiment.

Referring to FIG. 13, in other embodiments, a blade style club head 600 can comprise similar features to blade style club head 100. Specifically the blade style club head 600 can comprise comprises a similar strikeface (110, 610) formed at a front of the body (108, 608), a heel (118, 618), a toe (120, 620) opposite the heel (118, 618), a rear (124, 624) opposite the strike face (110, 610), a rear wall (125, 625) opposite the strike face (110, 610) a top rail (112, 612) positioned adjacent to the strikeface (110, 610) and adjacent to the rear wall (125, 625), a sole (122, 622) opposite the top rail (112, 612), and a leading edge (130, 630) adjacent the strike face (110, 610) and sole (122, 622). Further, blade style club head 600 can comprise a similar length, height, depth, mass, and volume as blade style club head 100.

In comparison to Embodiment 1, depicted in FIG. 2, the blade style club head 600 comprises different perimeter weights. As shown in FIG. 9 the perimeter weights 632 comprise a portion of the toe, a portion of the sole, and a portion of the heel. The perimeter weights 632 can comprise the rearmost portion of the toe and heel. The position of the perimeter weights 632 can allow for a low and rearwardly positioned CG.

Each of the perimeter weights 632 can comprise a mass. In some embodiments, the mass of the perimeter weights 632 can be between 20 grams and 75 grams. In some embodiments, the mass of each perimeter weights 632 can be between 20 grams and 25 grams, 25 grams and 30 grams, 30 grams and 35 grams, 35 grams and 40 grams, 40 grams and 45 grams, 45 grams and 50 grams, 50 grams and 55 grams, 60 grams and 65 grams, 65 grams and 70 grams, or 70 grams and 75 grams. The perimeter weights 632 comprise tungsten.

The addition of the perimeter weights 632 allows for a shift in weight, towards the periphery of the blade style club head, which can increase the MOI or forgiveness of the club head. The perimeter weights 632 can further comprise a center of gravity (hereafter referred to as "the $CG_w$"). The $CG_w$ can be positioned a distance away from the CG. More specifically the position of the perimeter weights 632 can provide the greatest impact on the MOIyy. Therefore, the greater the distance of the $CG_w$ from the y-axis the greater the increase of the MOIyy. In some embodiments, the distance y-axis to the $CG_w$ can be between ±1.5 inches and ±3.5 inches. In some embodiments, the distance from the y-axis to the $CG_w$ can be between ±1.50 inches and ±1.75 inches, ±1.75 inches and ±2.00 inches, 2.00 inches and ±2.25 inches, ±2.25 inches and ±2.50 inches, 2.50 inches and ±2.75 inches, 2.75 inches and ±3.00 inches, 3.00 inches and ±3.25 inches, or ±3.25 inches and ±3.50 inches. In some embodiments, the distance from the y-axis 138 to the $CG_w$ can be greater than ±1.50 inches, greater than ±1.75 inches, greater than ±2.00 inches, greater than ±2.25 inches, greater than ±2.50 inches, greater than ±2.75 inches, greater than ±3.00 inches, or greater than ±3.25 inches.

A percent of the total mass is positioned outside (toeward or heelward) the first set of planes. In some embodiments, between 65% and 85% of the total mass is positioned outside the first set of planes. In some embodiments, the percentage of total mass positioned outside the first set of planes is between 65% and 70%, 70% and 75%, 75% and 80%, or 80% and 85% of the total mass. In some embodiments, the percentage of the total mass of the club head positioned outside the first set of planes is greater than 65%, greater than 70%, greater than 75%, greater than 80% or greater than 85%.

A percent of the total mass is positioned outside (toeward or heelward) the second set of planes. In some embodiments, between 50% and 70% of the total mass is positioned outside the second set of planes. In some embodiments, the percentage of total mass positioned outside the second set of planes is between 50% and 55%, 55% and 60%, 60% and 65%, or 65% and 70% of the total mass. In some embodiments, the percentage of the total mass of the club head positioned outside the second set of planes is greater than 50%, greater than 55%, greater than 60%, or greater than 65.

A percent of the total mass is positioned outside (toeward or heelward) the third set of planes. In some embodiments, between 25% and 55% of the total mass is positioned outside the third set of planes. In some embodiments, the percentage of total mass positioned outside the third set of planes is between 25% and 35%, 35% and 45%, or 45% and 55% of the total mass. In some embodiments, the percent of the total mass of the clubhead positioned outside the third set of planes is greater than 25%, greater than 35%, greater than 45%, or greater than 55%.

A percent of the total mass is positioned outside (toeward or heelward) the fourth set of planes. In some embodiments, between 5% and 25% of the total mass is positioned outside the fourth set of planes. In some embodiments, the percentage of total mass positioned outside the fourth set of planes is between 5% and 10%, 10% and 15%, 15% and 20%, or 20% and 25% of the total mass. In some embodiments, the percentage of total mass of the clubhead positioned outside the fourth set of planes is greater than 5%, greater than 10%, greater than 15%, greater than 20% or greater than 25%.

A percent of the total mass is positioned outside (toeward or heelward) the fourth set of planes. In some embodiments, between 5% and 25% of the total mass is positioned outside the fourth set of planes. In some embodiments, the percentage of total mass positioned outside the fourth set of planes is between 5% and 10%, 10% and 15%, 15% and 20%, or 20% and 25% of the total mass. In some embodiments, the percentage of total mass of the clubhead positioned outside the fourth set of planes is greater than 5%, greater than 10%, greater than 15%, greater than 20% or greater than 25%.

G. Embodiment 7

Referring to FIG. 14, in other embodiments, a blade style club head 700 can comprise similar features to blade style club head 100. Specifically the blade style club head 700 can comprise comprises a similar strikeface formed at a front of the body, a heel (118, 718), a toe (120, 720) opposite the heel (118, 718), a rear (124, 724) opposite the strike face (110, 710), a rear wall (125, 725) opposite the strike face (110, 710) a top rail (112, 712) positioned adjacent to the strikeface (110, 710) and adjacent to the rear wall (125, 725), a sole (122, 722) opposite the top rail (112, 712), and a leading edge (130, 730) adjacent the strike face (110, 710) and sole (122, 722). Further, blade style club head 700 can comprise a similar length, height, depth, mass, and volume as blade style club head 100.

In comparison to Embodiment 1, depicted in FIG. 2, the blade style club head 700 comprises different perimeter weights. As shown in FIG. 14 the perimeter weights 732 comprise 2 weights positioned on the strikeface. Further, the perimeter weights 732 are positioned on the proximal the sole and toe. The perimeter weight 732 can be positioned with 0.50 inches of the sole and within 0.50 inch of the heel and toe. The position of the perimeter weights 532 can allow for the majority of the mass to be positioned as far from the CG as possible, increasing the MOIyy.

Each of the perimeter weights 732 can comprise a mass. In some embodiments, the mass of the perimeter weights 732 can be between 20 grams and 75 grams. In some embodiments, the mass of each perimeter weights 732 can be between 20 grams and 25 grams, 25 grams and 30 grams, 30 grams and 35 grams, 35 grams and 40 grams, 40 grams and 45 grams, 45 grams and 50 grams, 50 grams and 55 grams, 60 grams and 65 grams, 65 grams and 70 grams, or 70 grams and 75 grams. The perimeter weights 732 comprise tungsten.

The addition of the perimeter weights 732 allows for a shift in weight, towards the periphery of the blade style club head, which can increase the MOI or forgiveness of the club head. The perimeter weights 732 can further comprise a center of gravity (hereafter referred to as "the $CG_w$"). The $CG_w$ can be positioned a distance away from the CG. More specifically the position of the perimeter weights 632 can provide the greatest impact on the MOIyy. Therefore, the greater the distance of the $CG_w$ from the y-axis the greater the increase of the MOIyy. In some embodiments, the distance y-axis to the $CG_w$ can be between ±1.5 inches and ±3.5 inches. In some embodiments, the distance from the y-axis to the $CG_w$ can be between ±1.50 inches and ±1.75 inches, ±1.75 inches and ±2.00 inches, 2.00 inches and ±2.25 inches, ±2.25 inches and ±2.50 inches, 2.50 inches and ±2.75 inches, 2.75 inches and ±3.00 inches, 3.00 inches and ±3.25 inches, or ±3.25 inches and ±3.50 inches. In some embodiments, the distance from the y-axis 138 to the $CG_w$ can be greater than ±1.50 inches, greater than ±1.75 inches, greater than ±2.00 inches, greater than ±2.25 inches, greater than ±2.50 inches, greater than ±2.75 inches, greater than ±3.00 inches, or greater than ±3.25 inches.

A percent of the total mass is positioned outside (toeward or heelward) the first set of planes. In some embodiments, between 65% and 85% of the total mass is positioned outside the first set of planes. In some embodiments, the percentage of total mass positioned outside the first set of planes is between 65% and 70%, 70% and 75%, 75% and 80%, or 80% and 85% of the total mass. In some embodiments, the percentage of the total mass of the club head positioned outside the first set of planes is greater than 65%, greater than 70%, greater than 75%, greater than 80% or greater than 85%.

A percent of the total mass is positioned outside (toeward or heelward) the second set of planes. In some embodiments, between 50% and 70% of the total mass is positioned outside the second set of planes. In some embodiments, the percentage of total mass positioned outside the second set of planes is between 50% and 55%, 55% and 60%, 60% and 65%, or 65% and 70% of the total mass. In some embodiments, the percentage of the total mass of the club head positioned outside the second set of planes is greater than 50%, greater than 55%, greater than 60%, or greater than 65.

A percent of the total mass is positioned outside (toeward or heelward) the third set of planes. In some embodiments, between 25% and 55% of the total mass is positioned outside the third set of planes. In some embodiments, the percentage of total mass positioned outside the third set of planes is between 25% and 35%, 35% and 45%, or 45% and 55% of the total mass. In some embodiments, the percent of the total mass of the clubhead positioned outside the third set of planes is greater than 25%, greater than 35%, greater than 45%, or greater than 55%.

A percent of the total mass is positioned outside (toeward or heelward) the fourth set of planes. In some embodiments, between 5% and 25% of the total mass is positioned outside the fourth set of planes. In some embodiments, the percentage of mass positioned outside the fourth set of planes is between 5% and 10%, 10% and 15%, 15% and 20%, or 20% and 25% of the total mass. In some embodiments, the percentage of total mass of the clubhead positioned outside the fourth set of planes is greater than 5%, greater than 10%, greater than 15%, greater than 20% or greater than 25%.

A percent of the total mass is positioned outside (toeward or heelward) the fourth set of planes. In some embodiments, between 5% and 25% of the total mass is positioned outside the fourth set of planes. In some embodiments, the percentage of mass positioned outside the fourth set of planes is between 5% and 10%, 10% and 15%, 15% and 20%, or 20% and 25% of the total mass. In some embodiments, the percentage of total mass of the clubhead positioned outside the fourth set of planes is greater than 5%, greater than 10%, greater than 15%, greater than 20% or greater than 25%.

II. EXAMPLES

A. Example 1

Example 1 illustrates comparative results related to CG location and MOI between a first exemplary club head and a traditional blade style club head (also referred to as "control blade"). Described herein is a first exemplary blade style club head (also referred to as a "test blade"), having similar dimensions and physical characteristics as blade style club head 100.

Traditional blade type putters have an average length of 4.5 inches, a depth ranging from approximately 0.5 inches to 1.75 inches, and a height that ranges from approximately 0.80 inches to 1.00 inches. The control blade can comprise the following physical dimensions: a length of 4.57 inches, a depth of 1.11 inches, and a height of 0.92 inches. The test blade can comprise the following physical dimensions: a length of 6.000 inches, a depth of 1.650 inches, and a height of 1.344 inches. A direct comparison between the test blade and the control blade can be seen below in Table 1.

TABLE 1

| | Test Blade | Control Blade | % Increase |
|---|---|---|---|
| Head Mass (g) | 345 | 350 | −1.43% |
| Head MOI [MOIyy] (g*in^2) | 1225 | 678 | 80.67% |
| Height (in) | 1.344 | .92 | 46.09% |
| Length (in) | 6.00 | 4.57 | 31.29% |
| Depth (in) | 1.650 | 1.11 | 48.65% |
| MOIyy/CGz (abs) | 2052 | 1488 | 37.90% |
| % Mass Outside 1st Set of Planes | 75 | 67 | 11.94% |
| % Mass outside 2nd Set of Planes | 58 | 35 | 65.71% |
| % Mass outside 3rd Set of Planes | 40 | 10 | 400% |
| % Mass outside 4th Set of Planes | 17 | 0 | — |

The test blade, when compared to the control blade, has a 31.29% longer length, a 48.65% greater depth, and a 46.09% greater height. This length increase, along with placement of mass in the zones further from the center axis of the putter, leads to a more down and back positioning of the CG of the blade style club head. This mass positioning creates a greater MOIyy of the test blade compared to the test blade. Further, as shown in FIG. 1, the hosel of the test blade is located at the same point, relative to the club head's CG, as the traditional blade style golf club head. This ensures the test blade still possesses the same toe hang associated with a traditional blade style golf club head.

While the large blade style putter is very similar to the traditional style blade putter in terms of its design, the large blade style putter has a significantly greater ratio of club head moment of inertia in relation to the y-axis (MOIyy) to the clubhead center of center of gravity in the z-direction (CGz). In this embodiment, the increased MOIyy/CGz ratio is achieved through increased length, depth, and width dimensions on the large blade style putter as well as through implementation of perimeter toe and heel weights. The larger dimensions of the test blade allow the club head to achieve a 80.67% larger moment of inertia in relation to the y-axis compared to the control blade. Further, the ratio of MOIyy/CGz for the test blade is 37.90% greater compared to the control blade. This larger MOIyy over CGz ratio directly translates to the test blade club head being more forgiving than the control blade club head, as it prevents undesirable rotation about the y-axis (sole to crown) and helps to ensure the strikeface is square at impact.

Further, the increased dimensions when combined with perimeter weighting move mass further in the heel and toe directions from the club center of gravity when compared to traditional blade style golf club heads. In Embodiment 1, 75.2% of the total mass is outside first planes perpendicular to the strikeface and 1" from the geometric center of the clubhead. Additionally, 57.5% of the total mass is outside second planes perpendicular to the strikeface and 1.5" from the geometric center of the clubhead. Further, 39.7% of the total mass is outside third planes perpendicular to the strikeface and 2" from the geometric center of the clubhead. Finally, 17.2% of the total mass is outside fourth planes perpendicular to the strikeface and 2.5" from the geometric center of the clubhead. As summarized in Table 1 above, the test blade has more weight outside the first, second, third, and fourth planes when compared to the control blade.

B. Example 2

Several tests have been conducted which demonstrate that users experience significant improvements in putts made when using the test blade described above. The test blade in this example was consistent with the first exemplary putter type golf club head described in Example 1 above, and had the same 35-inch shaft, standard grip, loft, and lie as the control blade. In the tests, users of various skill levels attempted putts with both putters from several distances including a long putt from greater than 20 feet; a medium length putt from 10-20 feet; and a short putt from inside 10 feet from the target.

Tests were staggered such that some users completed a first test with the test blade. The first test was followed by second and third tests with the control blade. Finally, the test concluded by again putting with the test blade (a fourth test). Other users did the opposite (a first test with the control blade, followed by two tests with the control blade, and finishing with a fourth test with the test blade).

Figure 15A:
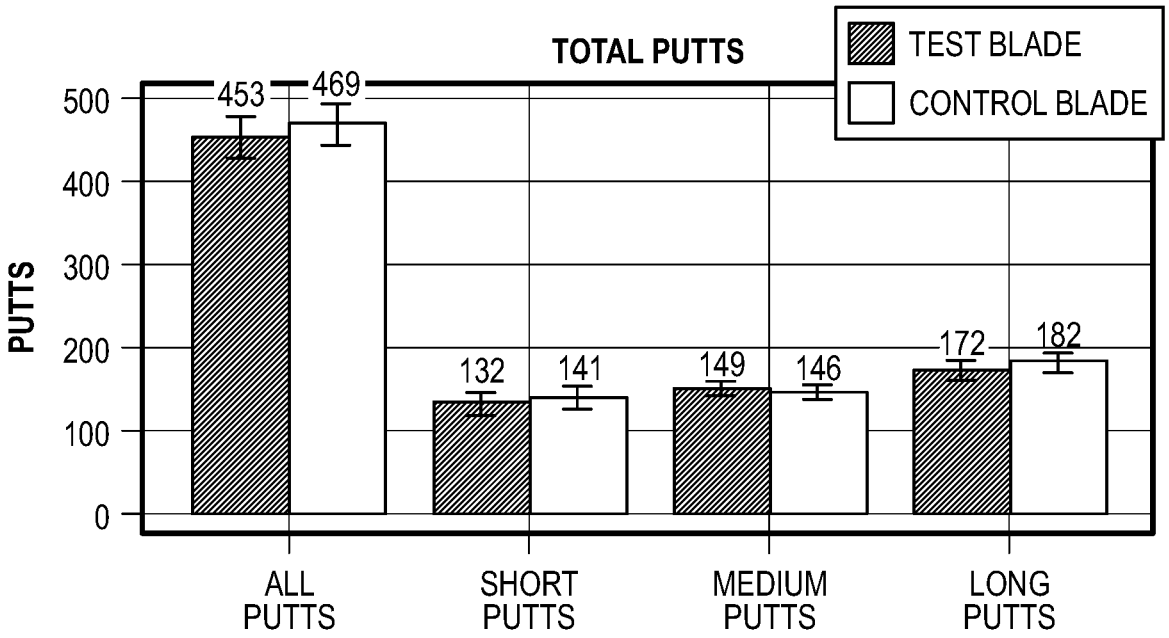
FIG. 15*a*: illustrates performance testing results wherein the first embodiment of the present invention was compared to a traditional blade putter.
Figure 15B:
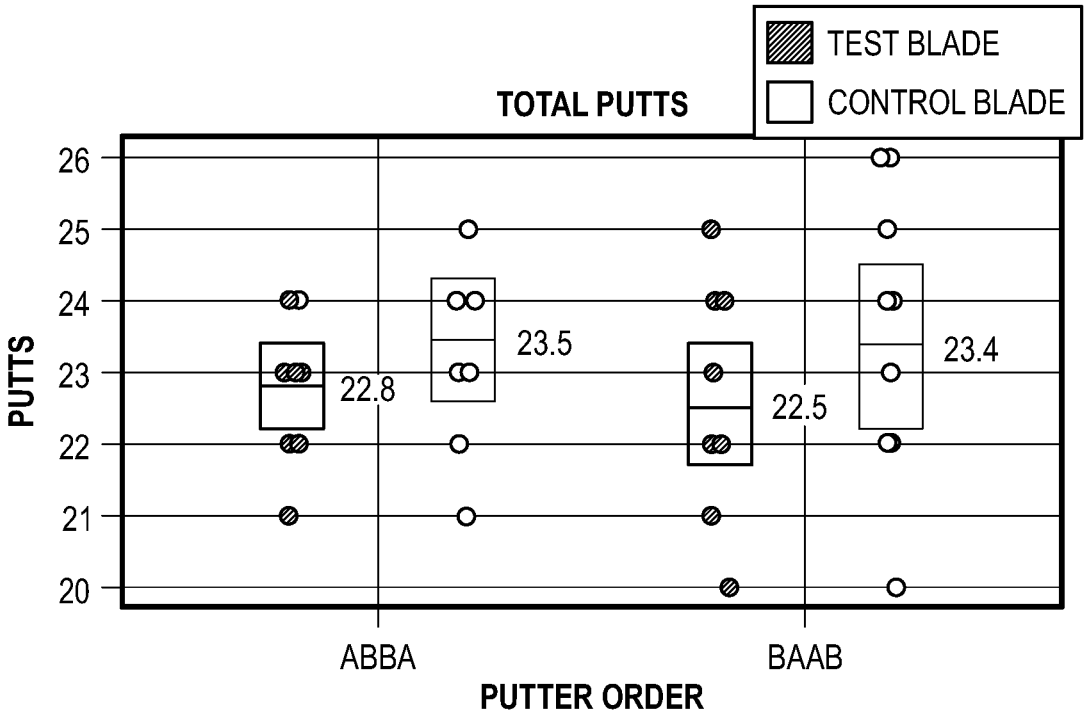
FIG. 15*b*: illustrates performance testing results wherein the first embodiment of the present invention was compared to a traditional blade putter.
Figure 15C:
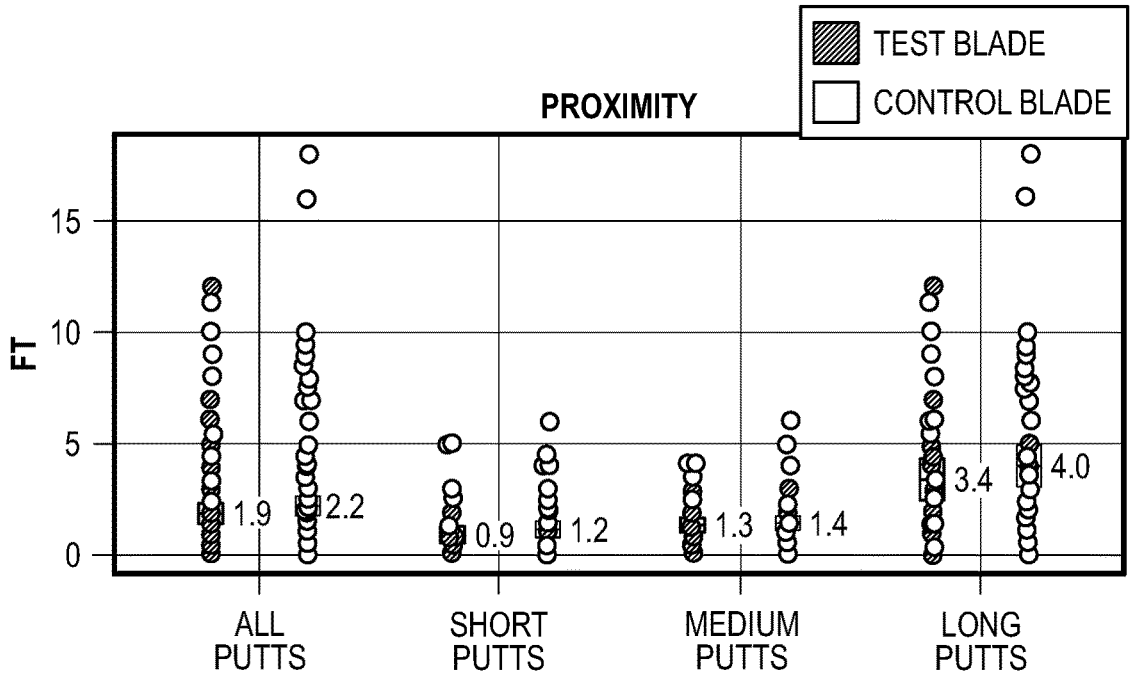
FIG. 15*c*: illustrates performance testing results wherein the first embodiment of the present invention was compared to a traditional blade putter.
Figure 15D:
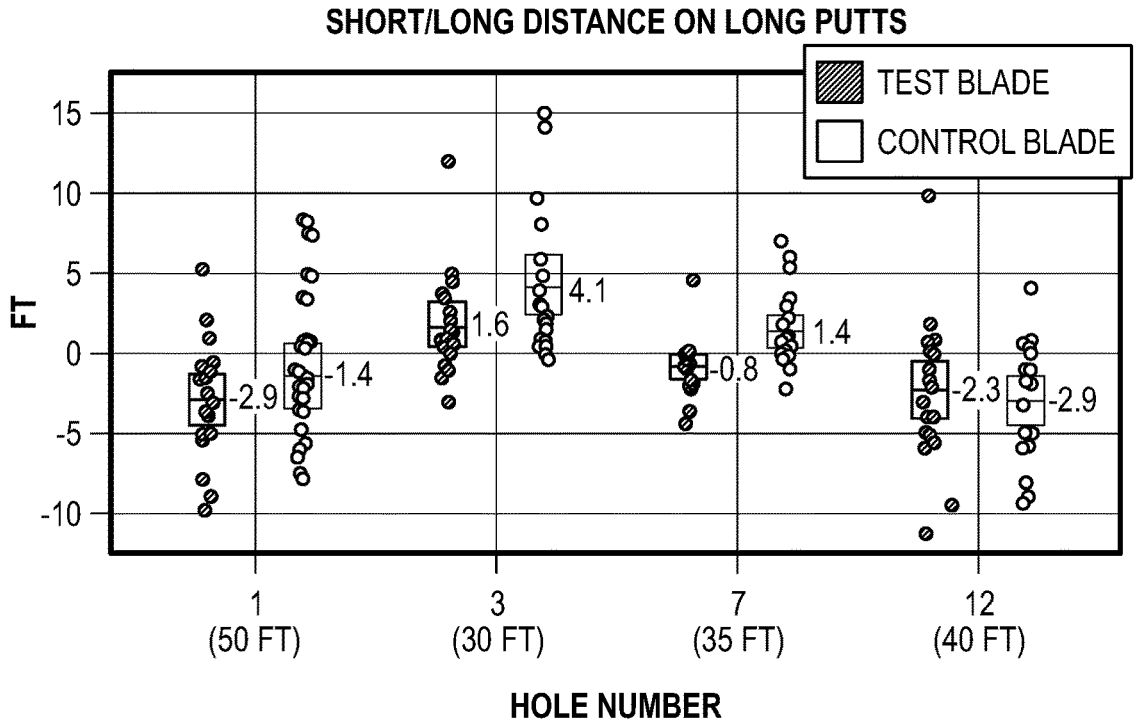
FIG. 15*d*: illustrates performance testing results wherein the first embodiment of the present invention was compared to a traditional blade putter.
Figure 15E:
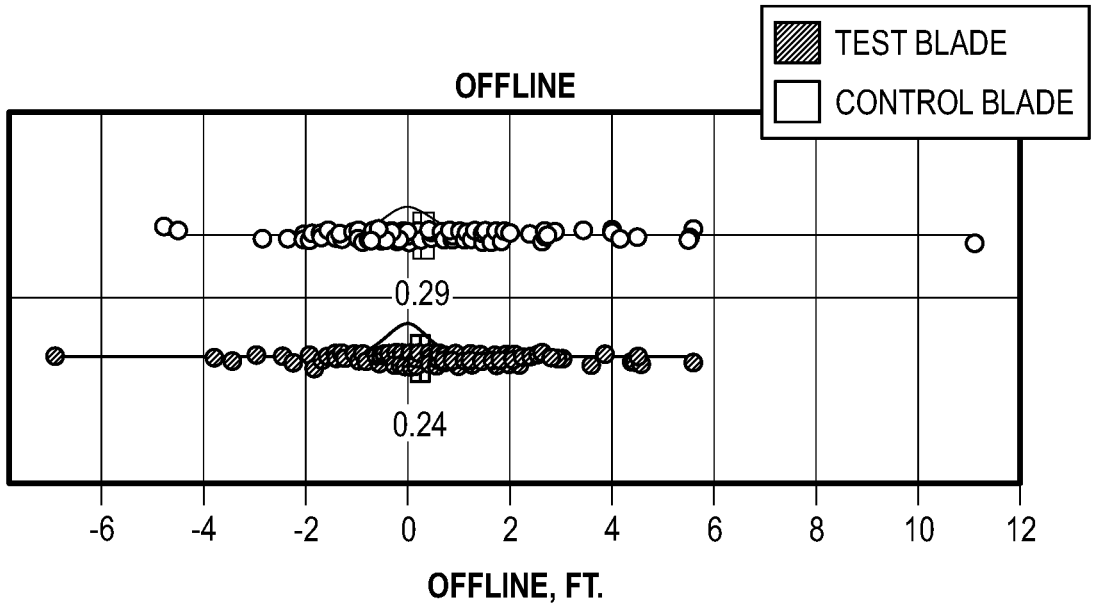
FIG. 15*e*: illustrates performance testing results wherein the first embodiment of the present invention was compared to a traditional blade putter.

The results of the tests, summarized in FIG. 15*a*, demonstrate that users performed better with the test blade compared to the control blade, averaging 3.41 less putts per 100 attempts. Additionally, putts with the test blade resulted in an average 0.03 feet closer proximity to the hole after the putt for all putts, with this trend occurring for short, medium, and long putts as shown in FIG. 15*c*. FIG. 15*e* shows that putts were also 0.05 feet less offline with the test blade compared to the control blade. As is demonstrated by the data presented in FIGS. 15*a*-15*e*, the test blade achieved better performance compared to the control blade in terms of putts made, putt proximity to the hole, and putt distance offline.

C. Example 3

Example 3 illustrates comparative results related to CG location and MOI between a first exemplary blade style golf club head and a traditional mallet style golf club head (also referred to as "control mallet"). Described herein is a first exemplary blade style club head (also referred to as "test blade"), having similar dimensions and physical characteristics as blade style club head 100.

Traditional mallet style putters typically have a higher MOI than blade style putters. This higher MOI is typically achieved by increasing the depth of the putter to put more weight further rear of the club strikeface. This higher MOI leads to increased forgiveness on a mallet putter when compared to a blade style putter. However, simple geometric modifications made to arrive at the test blade allow the embodiment to achieve better performance by incorporating the forgiveness typically associated with higher MOI mallet style putters into a blade style putter. Traditional mallet type putters have an average length ranging from 3.5 to 4.5 inches, a depth ranging from approximately 2 inches to 5 inches, and a height that ranges from approximately 0.80 inches to 1.00 inches. The control mallet can comprise the following physical dimensions: a length of 3.90 inches, a depth of 3.71 inches, and a height of 1.00 inches.

The control mallet was compared with the test blade described in Example 1. The test blade was similar to golf club head 100 of Embodiment 1, as described above, having a length of 6.000 inches, a depth of 1.650 inches, and a height of 1.344 inches. A direct comparison between the test blade and the control mallet can be seen below in Table 2.

TABLE 2

| | Test Blade | Control Mallet | % Increase |
|---|---|---|---|
| Head Mass (g) | 345 | 382 | −9.69% |
| Head MOI [MOIyy] (g*in^2) | 1225 | 995 | 23.12% |
| Height (in) | 1.344 | 0.97 | 38.56% |
| Length (in) | 6.00 | 3.9 | 53.85% |
| Depth (in) | 1.650 | 3.68 | −55.16% |
| MOIyy/CGz (abs) | 2052 | 575 | 356.87% |
| % Mass outside $1^{st}$ Plane | 75 | 48 | 56.25% |
| % Mass outside $2^{nd}$ Plane | 58 | 20 | 290.00% |
| % Mass outside $3^{rd}$ Plane | 40 | 0 | — |
| % Mass outside $4^{th}$ Plane | 17 | 0 | — |

The test blade, when compared to the control mallet, has a 53.85% longer length, a 55.16% less depth, and a 38.56% greater height. This length increase, along with placement of mass in the zones further from the center axis of the putter, leads to a more down and back positioning of the CG of the blade style club head. This mass positioning creates a greater MOIyy of the test blade compared to the test mallet. Further, as shown in FIG. 1, the hosel of the test blade is located at the same point, relative to the club head's CG, as the traditional blade style golf club head. This ensures the test blade still possesses the same toe hang associated with a traditional blade style golf club head.

The large blade style putter, when compared to the control mallet, has a significantly greater ratio of club head moment of inertia in relation to the y-axis (MOIyy) to clubhead center of center of gravity in the z-direction (CGz). In this embodiment, the increased MOIyy/CGz ratio is achieved through increased length and width dimensions on the large blade style putter versus the control mallet, as well as through implementation of perimeter toe and heel weights. The larger dimensions of the test blade, as mentioned above, allow the test blade club head to achieve a 23.12% larger moment of inertia in relation to the y-axis compared to the control blade. Further, the ratio of MOIyy/CGz for the test blade is 356.87% greater compared to the control mallet club head. This larger MOIyy over CGz ratio directly translates to the test blade club head being more forgiving than the control mallet club head, as it prevents undesirable rotation about the y-axis (sole to crown) and helps to ensure the strikeface is square at impact.

Further, the increased dimensions of the test blade, when combined with perimeter weighting, move mass further in the heel and toe directions from the club center of gravity, when compared to traditional mallet style golf club heads. In Embodiment 1, 75.2% of the total mass is outside first planes perpendicular to the strikeface and 1" from the geometric center of the clubhead. Additionally, 57.5% of the total mass is outside second planes perpendicular to the strikeface and 1.5" from the geometric center of the clubhead. Further, 39.7% of the total mass is outside third planes perpendicular to the strikeface and 2" from the geometric center of the club head. Finally, 17.2% of the total mass is outside fourth planes perpendicular to the strikeface and 2.5" from the geometric center of the club head. As seen in Table 2 above, the test blade has more weight outside the first, second, third, and fourth planes when compared to the control mallet.

D. Example 4

Several tests have been conducted which demonstrate that users experience significant improvements in putts made when using the test blade described above. The test blade in this example was consistent with the first exemplary putter type golf club head described in Example 1 above, and had the same 35-inch shaft, standard grip, loft, and lie as the control blade. In the tests, users of various skill levels attempted putts with both putters from several distances including a long putt from greater than 20 feet; a medium length putt from 10-20 feet; and a short putt from inside 10 feet from the target.

Tests were staggered such that some users completed a first test with the test blade. The first test was followed by second and third tests with the control mallet. Finally, the test concluded by again putting with the test blade (a fourth test). Other users did the opposite (a first test with the control blade, followed by two tests with the control mallet, and finishing with a fourth test with the test blade).

Figure 16A:
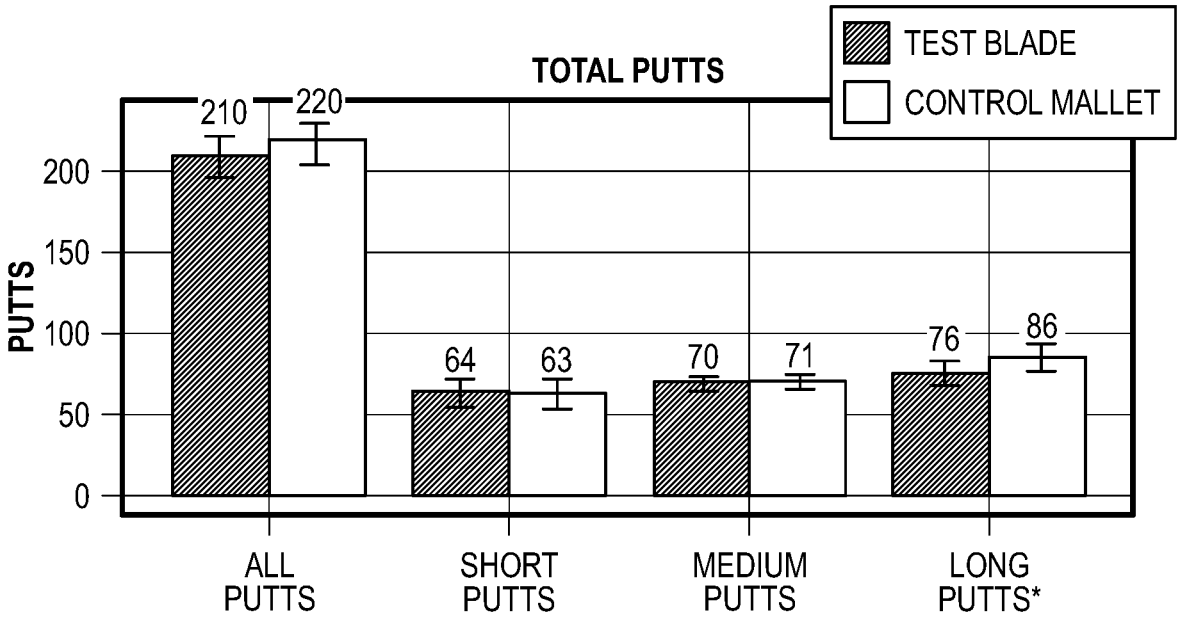
FIG. 16*a*: illustrates performance testing results wherein the first embodiment of the present invention was compared to a traditional mallet putter.
Figure 16B:
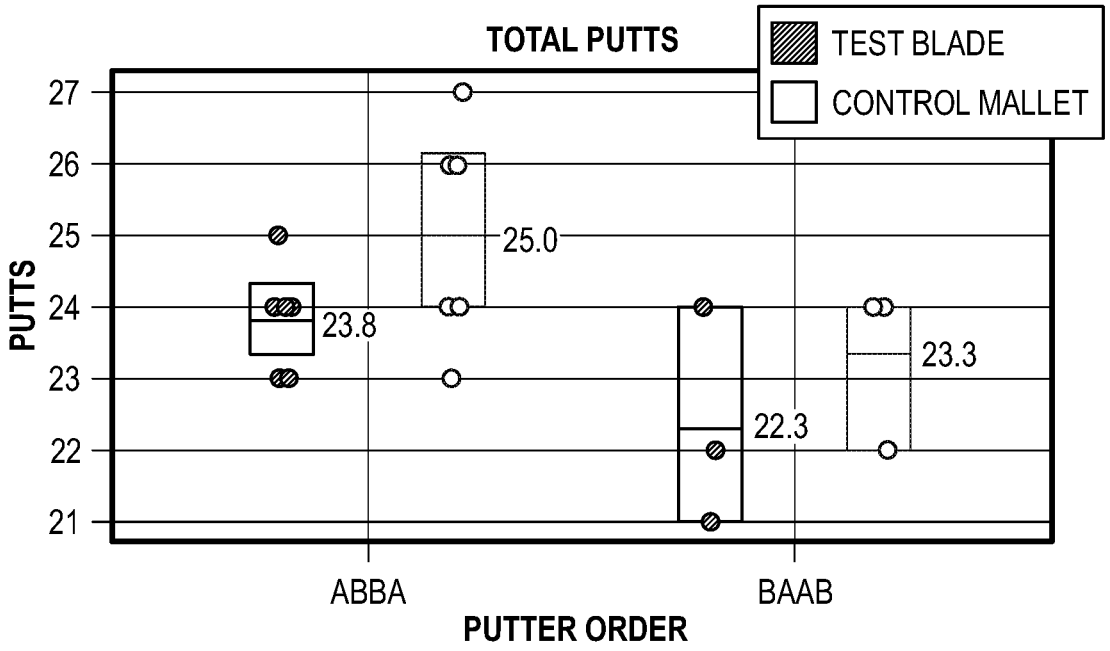
FIG. 16*b*: illustrates performance testing results wherein the first embodiment of the present invention was compared to a traditional mallet putter.
Figure 16C:
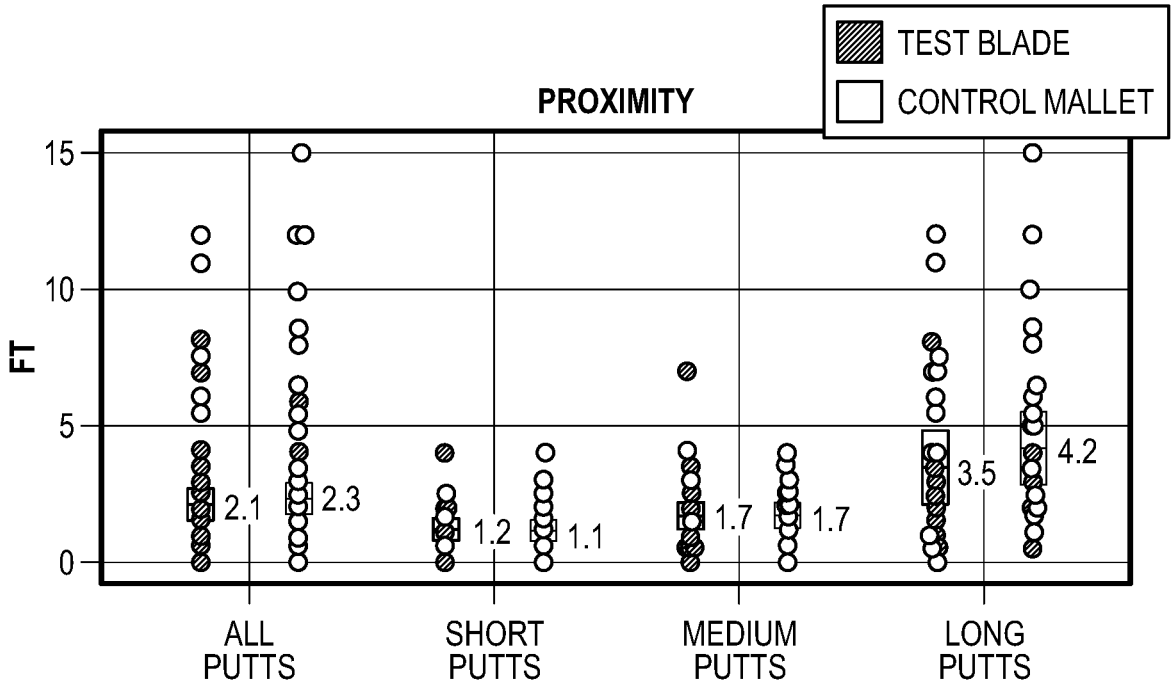
FIG. 16*c*: illustrates performance testing results wherein the first embodiment of the present invention was compared to a traditional mallet putter.
Figure 16D:
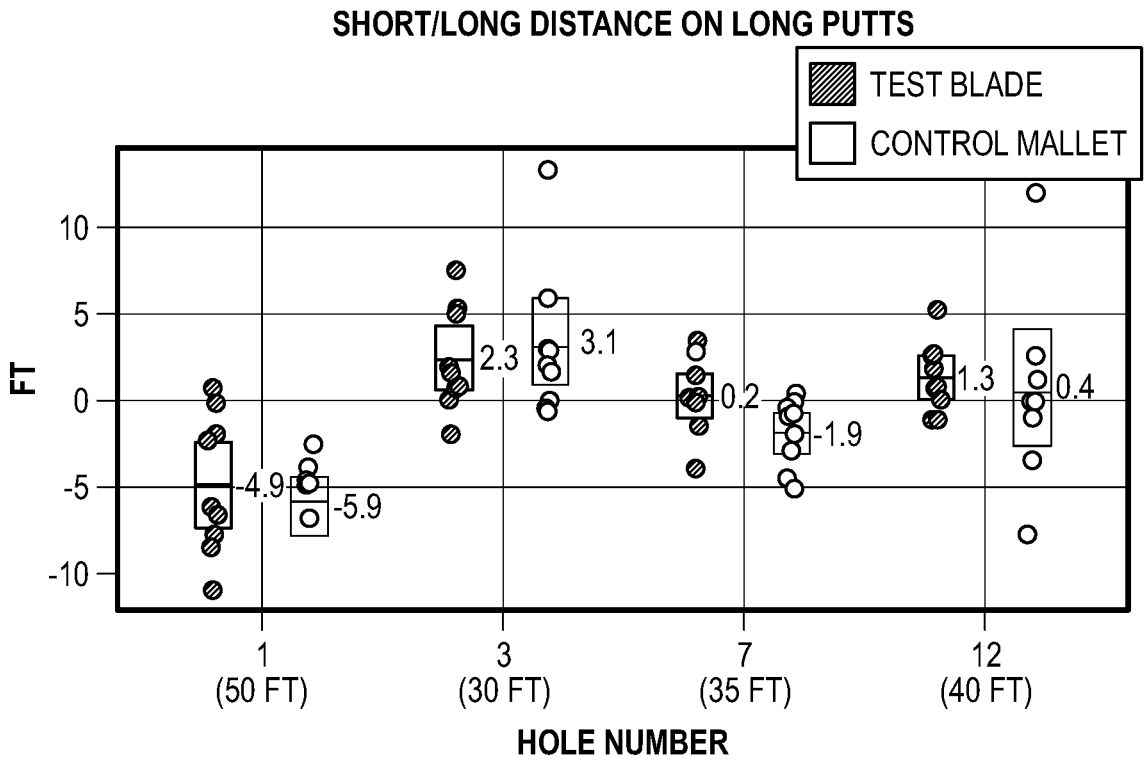
FIG. 16*d*: illustrates performance testing results wherein the first embodiment of the present invention was compared to a traditional mallet putter.
Figure 16E:
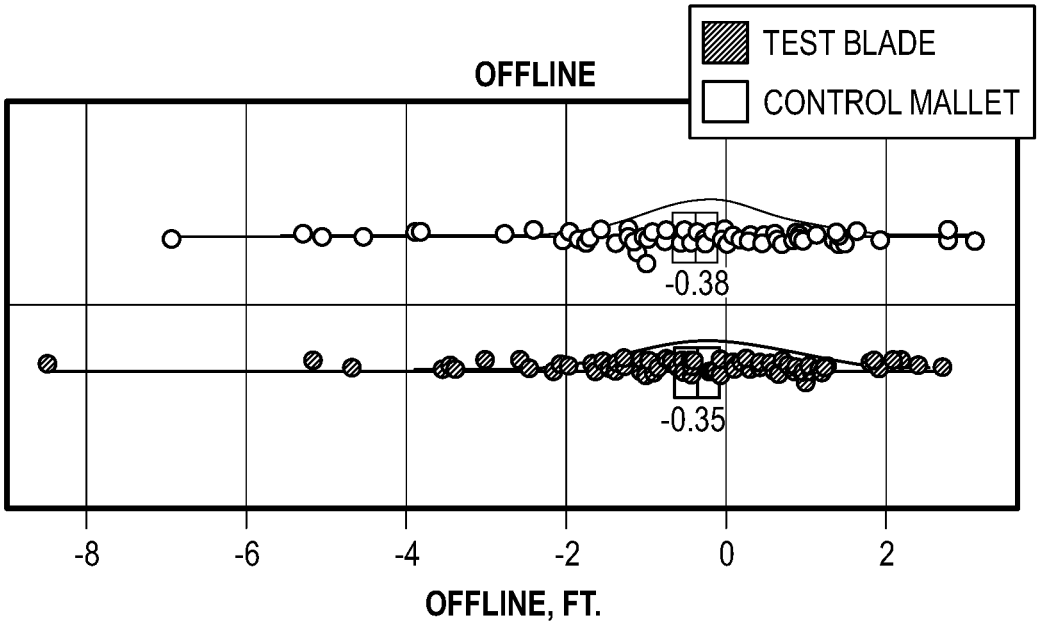
FIG. 16*e*: illustrates performance testing results wherein the first embodiment of the present invention was compared to a traditional mallet putter.

The results of these tests, summarized in FIG. 16*a*, demonstrate that users performed better with the test blade compared to the control mallet, making 4.55 more putts per 100 attempts with the test blade. FIG. 16*c* demonstrates that, on average, the test blade also left putts an average of 0.2 feet closer to the hole compared to the control mallet. FIG. 16*e* shows that putts were also 0.03 feet less offline with the test blade compared to the control mallet. As is demonstrated by the data presented in FIGS. 16*a*-16*e*, the test blade achieved better performance compared to the control mallet in terms of putts made, putt proximity to the hole, and putt distance offline. FIG. 16*e* shows that putts were also 0.03 feet less offline with the test blade compared to the control mallet. As is demonstrated by the data presented in FIGS. 16*a*-16*e*, the test blade achieved better performance compared to the control mallet in terms of putts made, putt proximity to the hole, and putt distance offline.

Clauses

Clause 1. A blade style putter type club head comprising: a strikeface, a rear opposite the strikeface; a heel, a toe opposite the heel, a top rail, a sole a hosel, and perimeter weighting; a club head center of gravity (CG location); an XYZ coordinate system; wherein an origin for the XYZ coordinate system is defined at a center point of a leading edge of the blade style putter type club head, the XYZ coordinate system having an x-axis, a y-axis, a z-axis; wherein; a horizontal x-axis extending from the heel to the toe; a vertical y-axis extending from the sole to the top rail; a horizontal z-axis extending from the strikeface to the rear; wherein a moment of inertia MOIyy about the y-axis greater than 1000 g-in2; a length, wherein: the length is measured from an outer most point of the toe to an outer most point of the heel in a direction parallel to the x-axis; the length is greater than 5.00 inches.

Clause 2. A blade style putter type club head of clause 1, wherein: the CG location is defined by points CGx, CGy, and CGz, respectively corresponding to points on the x-axis, y-axis, and z-axis; wherein: the CGx is measured parallel to the x-axis from the origin; the CGy is measured parallel to the y-axis from the origin; the CGz is measured parallel to the z-axis from the origin; wherein: the CGx is between 0.00 inches and 0.10 inches; the CGy is between 0.30 inches and 0.90 inches; and the CGz is between −0.35 inches and −01.10.

Clause 3. A blade style putter type club head of clause 2, further comprising a MOIyy/CGz ratio is greater than 1600 g*in.

Clause 4. The blade style putter type club head of clause 1, wherein a moment of inertia MOIxx about the x-axis greater than 100 g-in2.

Clause 5. The blade style putter type club head of clause 1, wherein a moment of inertia MOIzz about the z-axis greater than 1000 g-in2.

Clause 6. The blade style putter type club head of clause 1, wherein the perimeter weighting consist of one or more perimeter weights.

Clause 7. The blade style putter type club head of clause 1, wherein the hosel comprises a hosel axis; wherein: the hosel axis is concentric with the hosel and is parallel to the y-axis; the hosel axis is positioned a distance Dh from the heel; wherein: the distance Dh is greater than 1.00 inch.

Clause 8. The blade style putter type club head of clause 1, wherein the perimeter weighting is integral to the blade style putter type club head.

Clause 9. The blade style putter type club head of clause 1, wherein the perimeter weighting forms the heel, toe, sole, and strikeface or portions thereof.

Clause 10. A blade style putter type club head comprising: a strike face, a rear opposite the strikeface; a heel, a toe opposite the heel, a top rail, a sole opposite the top rail, a hosel, and perimeter weighting; a total mass; a club head center of gravity (CG location); a GC plane; wherein the GC plane is a midplane that extends from the strikeface to the rear; a first set of planes, a second set of planes, a third set of planes and a fourth set of planes; wherein: the first set of planes is positioned a distance L1 from the GC plane; the second set of planes is positioned a distance L3 from the GC plane; the third set of planes is positioned a distance L5 from the GC plane; the fourth set of planes is positioned a distance L7 from the GC plane; and wherein between 30% and 50% of the total mass can be positioned outside the third set of planes and between 5% and 25% of the total mass.

Clause 11. The blade style putter type club head of clause 10, wherein: the distance L1 is 1.0 inch; the distance L3 is 1.5 inches; the distance L5 is 2.0 inches; and the distance L7 is 2.5 inches.

Clause 12. The blade style putter type club head of clause 10, further comprising:

an XYZ coordinate system; wherein an origin for the XYZ coordinate system is defined at a center point of a leading edge of the blade style putter type club head, the XYZ coordinate system having an x-axis, a y-axis, a z-axis; wherein; a horizontal x-axis extending from the heel to the toe; a vertical y-axis extending from the sole to the top rail; a horizontal z-axis extending from the strike face to the rear.

Clause 13. A blade style putter type club head of clause 12, wherein: the CG location is defined by points CGx, CGy, and CGz, respectively corresponding to points on the x-axis, y-axis, and z-axis; wherein: the CGx is measured parallel to the x-axis from the origin; the CGy is measured parallel to the y-axis from the origin; the CGz is measured parallel to the z-axis from the origin; wherein: the CGx is between 0.00 inches and 0.10 inches; the CGy is between 0.30 inches and 0.90 inches; and the CGz is between −0.35 inches and −01.10.

Clause 14. The blade style putter type club head of clause 12, wherein a moment of inertia MOIyy about the y-axis greater than 1000 g-in2.

Clause 15. The blade style putter type club head of clause 12, wherein a moment of inertia MOIxx about the x-axis greater than 100 g-in2.

Clause 16. The blade style putter type club head of clause 12, wherein a moment of inertia MOIzz about the z-axis greater than 1000 g-in2.

Clause 17. The blade style putter type club head of clause 10, further comprising a MOIyy/CGz ratio is greater than 1600 g*in.

Clause 18. The blade style putter type club head of clause 10, wherein the perimeter weighting consists of one or more perimeter weights.

Clause 19. The blade style putter type club head of clause 18, wherein each perimeter weight of the one or more perimeter weights comprise a mass and the mass is between 5 grams and 75 grams.

Clause 20. The blade style putter type club head of clause 10, wherein the perimeter weighting comprises a CGw, wherein: the CGw is positioned a distance away from the y-axis; and the distance is greater than 2.0 inches.

Clause 21. The blade style putter type club head of clause 10, wherein the perimeter weighting can be any one or combination of the following: perimeter weights, thickening regions of mass on a perimeter of the blade style putter type club head, or the inclusion of a mixture of hybrid materials.

Clause 22. The blade style putter type club head of clause 18, wherein the plurality of heel weights and the plurality of toe weights can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to $ocm^3ur$ or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Although the invention has been described with reference to specific embodiments, it will be understood by those skilled in the art that various changes may be made without departing from the spirit or scope of the invention. Accordingly, the disclosure of embodiments of the invention is intended to be illustrative of the scope of the invention and is not intended to be limiting.

What is claimed is:

1. A blade style putter type club head comprising:

a strikeface, a rear opposite the strikeface; a heel, a toe opposite the heel, a top rail, a sole a hosel, and perimeter weighting;

a club head center of gravity (CG location);

an XYZ coordinate system;

wherein an origin for the XYZ coordinate system is defined at a center point of a leading edge of the blade style putter type club head, the XYZ coordinate system having an x-axis, a y-axis, a z-axis;

wherein;

a horizontal x-axis extending from the heel to the toe;

a vertical y-axis extending from the sole to the top rail;

a horizontal z-axis extending from the strikeface to the rear;

wherein a moment of inertia MOIyy about the y-axis greater than 1000 g-in$^2$;

a length, wherein:

the length is measured from an outer most point of the toe to an outer most point; of the heel in a direction parallel to the x-axis; and the length is greater than 5.00 inches.

2. A blade style putter type club head of claim 1, wherein:

the CG location is defined by points CGx, CGy, and CGz, respectively corresponding to points on the x-axis, y-axis, and z-axis; wherein:

the CGx is measured parallel to the x-axis from the origin;

the CGy is measured parallel to the y-axis from the origin;

the CGz is measured parallel to the z-axis from the origin;

wherein:

the CGx is between 0.00 inches and 0.10 inches;

the CGy is between 0.30 inches and 0.90 inches; and the CGz is between −0.35 inches and −1.10.

3. A blade style putter type club head of claim 2, further comprising a MOIyy/CGz ratio greater than 1600 g-in.

4. The blade style putter type club head of claim 1, wherein a moment of inertia MOIxx about the x-axis greater than 100 g-in$^2$.

5. The blade style putter type club head of claim 1, wherein a moment of inertia MOIzz about the z-axis greater than 1000 g-in$^2$.

6. The blade style putter type club head of claim 1, wherein the perimeter weighting consist of one or more perimeter weights.

7. The blade style putter type club head of claim 1, wherein the hosel comprises a hosel axis;

wherein:

the hosel axis is concentric with the hosel and is parallel to the y-axis;

the hosel axis is positioned a distance $D_h$ from the heel;

wherein:

the distance $D_h$ is greater than 1.00 inch.

8. The blade style putter type club head of claim 1, wherein the perimeter weighting is integral to the blade style putter type club head.

9. The blade style putter type club head of claim 1, wherein the perimeter weighting forms the heel, toe, sole, and strikeface or portions thereof.

10. A blade style putter type club head comprising:

a strike face, a rear opposite the strikeface; a heel, a toe opposite the heel; a top rail, a sole opposite the top rail; a hosel, and perimeter weighting;

a total mass;

a club head center of gravity (CG location);

a GC plane;

wherein the GC plane is a midplane that extends from the strikeface to the rear;

a first set of planes, a second set of planes, a third set of planes, and a fourth set of planes;

wherein:

the first set of planes is positioned a distance L1 from the GC plane;

the second set of planes is positioned a distance L3 from the GC plane;

the third set of planes is positioned a distance L5 from the GC plane;

the fourth set of planes is positioned a distance L7 from the GC plane; and wherein between 30% and 50% of the total mass is positioned outside the third set of planes and between 5% and 25% of the total mass is positioned outside the fourth set of planes.

11. The blade style putter type club head of claim 10, wherein:

the distance L1 is 1.0 inch;

the distance L3 is 1.5 inches;

the distance L5 is 2.0 inches; and the distance L7 is 2.5 inches.

12. The blade style putter type club head of claim 10, further comprising:

an XYZ coordinate system;

wherein an origin for the XYZ coordinate system is defined at a center point of a leading edge of the blade style putter type club head, the XYZ coordinate system having an x-axis, a y-axis, a z-axis;

wherein;

a horizontal x-axis extending from the heel to the toe;

a vertical y-axis extending from the sole to the top rail; and a horizontal z-axis extending from the strike face to the rear.

13. A blade style putter type club head of claim 12, wherein:

the CG location is defined by points CGx, CGy, and CGz, respectively corresponding to points on the x-axis, y-axis, and z-axis; wherein:

the CGx is measured parallel to the x-axis from the origin;

the Cgy is measured parallel to the y-axis from the origin;

the CGz is measured parallel to the z-axis from the origin;

wherein:

the CGx is between 0.00 inches and 0.10 inches;

the Cgy is between 0.30 inches and 0.90 inches; and the CGz is between −0.35 inches and 1.10 inches.

14. The blade style putter type club head of claim 12, wherein a moment of inertia MOIyy about the y-axis is greater than 1000 g-in$^2$.

15. The blade style putter type club head of claim 12, wherein a moment of inertia MOIxx about the x-axis is greater than 100 g-in$^2$.

16. The blade style putter type club head of claim 12, wherein a moment of inertia MOIzz about the z-axis is greater than 1000 g-in$^2$.

17. The blade style putter type club head of claim 12, wherein the perimeter weighting comprises a $CG_w$, wherein:

the $CG_w$ is positioned a distance away from the y-axis; and the distance is greater than 2.0 inches.

18. A blade style putter type club head of claim 10, further comprising a MOIyy/CGz ratio greater than 1600 g*in.

19. The blade style putter type club head of claim 10, wherein the perimeter weighting consists of one or more perimeter weights.

20. The blade style putter type club head of claim 19, wherein each perimeter weight of the one or more perimeter weights comprise a mass and the mass is between 5 grams and 75 grams.

* * * * *